US012680146B1

(12) United States Patent
Xu et al.

(10) Patent No.: US 12,680,146 B1
(45) Date of Patent: Jul. 14, 2026

(54) CORROSION-RESISTANT ANTIBACTERIAL COPPER ALLOY, AND PREPARATION PROCESS AND APPLICATION FOR THE SAME

(71) Applicants: ZHEJIANG HAILIANG CO., LTD., Zhuji (CN); Zhejiang Copper Processing Research Institute Co., Ltd., Zhuji (CN)

(72) Inventors: Gaolei Xu, Zhuji (CN); Jingbo Gao, Zhuji (CN); Zhen Zhang, Zhuji (CN); Zhen Fan, Zhuji (CN); Jianguo Cao, Zhuji (CN); Luming Feng, Zhuji (CN); Xingdong Wang, Zhuji (CN); Junli Xu, Zhuji (CN)

(73) Assignees: ZHEJIANG HAILIANG CO., LTD., Zhuji (CN); Zhejiang Copper Processing Research Institute Co., Ltd., Zhuji (CN)

( * ) Notice: Subject to any disclaimer, the term of this patent is extended or adjusted under 35 U.S.C. 154(b) by 0 days.

(21) Appl. No.: 19/385,364

(22) Filed: Nov. 11, 2025

(30) Foreign Application Priority Data

Aug. 8, 2025 (CN) ..... 202511111821.7

(51) Int. Cl.
*C22C 9/00* (2006.01)
*C22F 1/08* (2006.01)

(52) U.S. Cl.
CPC . *C22C 9/00* (2013.01); *C22F 1/08* (2013.01)

(58) Field of Classification Search
CPC ..... C22C 9/00; C22F 1/08
See application file for complete search history.

(56) References Cited

U.S. PATENT DOCUMENTS 9,938,606 B2 * 4/2018 Maki ..... C23C 14/3414

FOREIGN PATENT DOCUMENTS

| | | | |
|---|---|---|---|
| CN | 102051500 | A | 5/2011 |
| CN | 103866159 | A | 6/2014 |
| CN | 105143478 | A | 12/2015 |
| CN | 117242197 | A | 12/2023 |
| CN | 118064759 | A | 5/2024 |
| CN | 118497548 | A | 8/2024 |
| CN | 120648935 | A | 9/2025 |
| JP | 2012062499 | A | 3/2012 |
| JP | 2014201814 | A | 10/2014 |
| JP | 2021123785 | A | 8/2021 |

OTHER PUBLICATIONS

Kita et al., Effects of Impurities on the Formation of Special Grain Boundaries of Pure Copper, Journal of Japan Institute of Copper, vol. 51, No. 1, pp. 42-46, dated Aug. 1, 2012.

* cited by examiner

*Primary Examiner* — Adam Krupicka
(74) *Attorney, Agent, or Firm* — Westbridge IP LLC

(57) ABSTRACT

A corrosion-resistant antibacterial copper alloy includes components having the following contents: B: 0.0035-0.055 wt. %; P: 0.15-0.35 wt. %; Si: 0.005-0.05 wt. %; an unavoidable impurity element with a content less than 0.1 wt. %; and a balance being copper. In the present disclosure, a copper alloy having both high antibacterial and excellent corrosion resistance may be obtained by using the foregoing alloy composition in combination with an improved preparation process. The copper alloy has broad application prospects in complex working conditions such as medical equipment, marine engineering, heat exchange devices or sanitary equipment.

13 Claims, 7 Drawing Sheets

Figure 1:
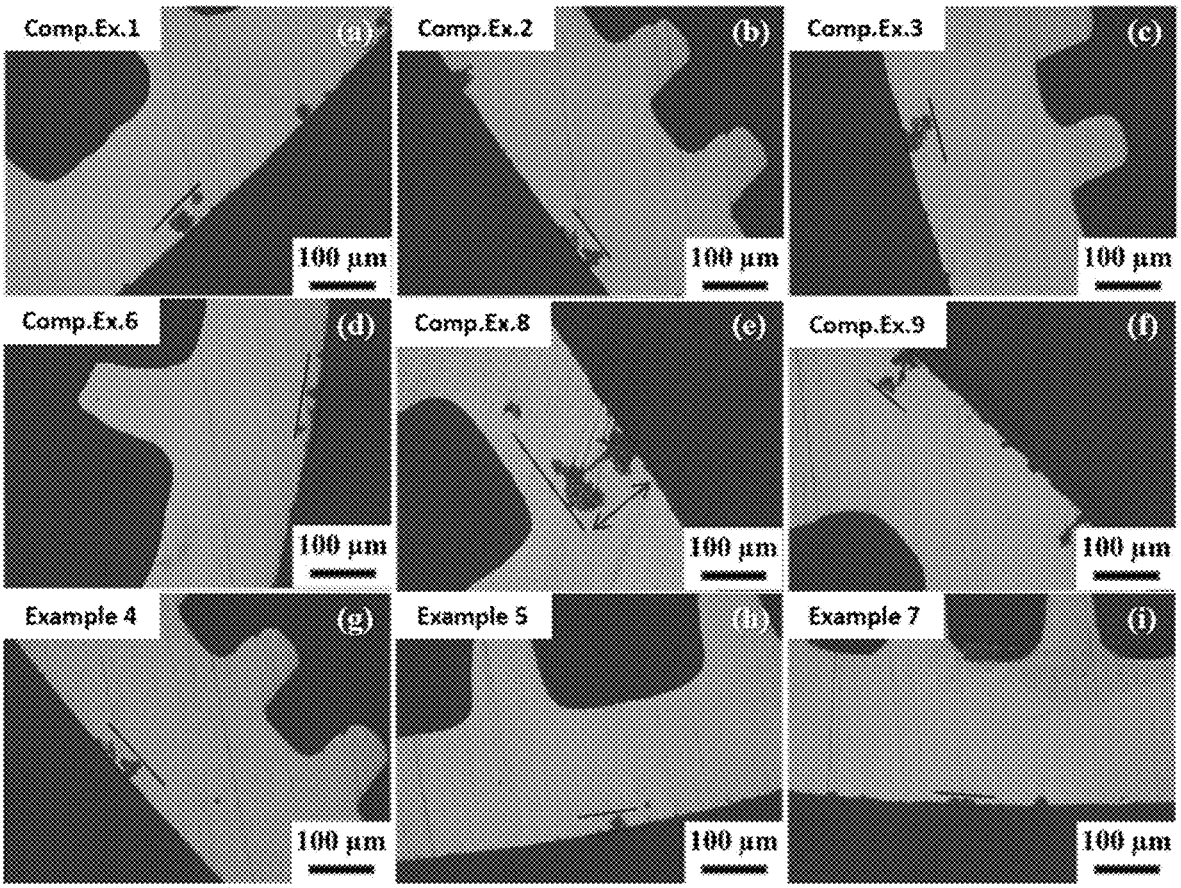

CORROSION-RESISTANT ANTIBACTERIAL COPPER ALLOY, AND PREPARATION PROCESS AND APPLICATION FOR THE SAME

CROSS-REFERENCE TO RELATED APPLICATIONS

The present disclosure claims priority to Chinese Patent Application No. 202511111821.7, filed on Aug. 8, 2025, which is hereby incorporated by reference in its entirety.

TECHNICAL FIELD

The present disclosure relates to the field of alloys, and in particular, to a corrosion-resistant antibacterial copper alloy, and a preparation method and an application for the same.

BACKGROUND

In the fields of medical equipment, marine engineering components, and heat exchange devices, copper alloys are widely used due to good thermal conductivity, ductility, and corrosion resistance. However, with service environments being complex (such as including high humidity, a corrosive medium, and stress coupling), a conventional copper alloy faces the following technical bottlenecks.

1. Challenge of Synergistic Regulation of Antibacterial Performance and Corrosion Resistance In the field of medical equipment, core components such as surgical instruments and disinfection devices have strict requirements on high antibacterial performance of the materials, which requires effective inhibition and killing of pathogenic bacteria such as *Escherichia coli* and *Staphylococcus aureus*. However, an antibacterial effect of the conventional copper alloy mainly depends on natural dissolution of copper ions. Under the control of normal composition and microstructure, antibacterial efficacy of the conventional copper alloy has obvious limitations. A 15-minute bactericidal rate of the typical conventional copper material (TP2) for the pathogenic bacteria only ranges from 20% to 30%. In addition, in a medical disinfection environment including chlorine ions, the material is prone to pitting corrosion, which eventually causes a structural failure and functional attenuation.

An essential mechanism of the foregoing contradiction lies in that: an enhanced antibacterial effect of copper and a copper alloy is directly dependent on effective dissolution of copper ions in a material system, and the copper ions destroy its spatial conformation and catalytic activity by combining with a key protease (such as a sulfhydryl enzyme) of bacterial metabolism, thus blocking pathway of energy metabolism and substance synthesis, and finally causing death of bacteria. However, the dissolution of copper ions is accompanied by charge transfer on a surface of the material, which causes electrochemical corrosion (such as anode dissolution) of the material.

2. Challenge of Synergistic Failure of Multi-Media Corrosion and Stress

When a heat exchange device (such as a condenser or an evaporator) is used at a high temperature and high pressure (10-30 MPa, and 150-300° C.) and in a complex moist medium with carboxylate and a nutritious surface, the conventional copper alloy faces double challenges.

Electrochemical corrosion: carboxylate ions easily react with copper to form a loose corrosion layer, resulting in local perforation; from a surface of a copper tube, a leakage channel is as small as a pinhole; however, on a cross-section of the copper tube, it may be seen that a corroded portion has interconnected, maze-like buried tunnels with branches connecting to each other. Because a shape of a corrosion channel is similar to that of an ant hole, it is called "ant-nest corrosion". The ant-nest corrosion is difficult to detect and progresses very quickly. A copper tube is used as an example. When a corrosion condition reaches 0.3 mA/cm$^2$, a corrosion rate of the copper tube may reach 10 μm/day. The research shows that one the ant-nest corrosion occurs, it is extremely harmful and will seriously affect normal operation of an air conditioning and refrigeration system.

Stress corrosion cracking (SCC): when alternating thermal stress is superposed with tensile/compressive stress, penetration of a corrosive medium at a grain boundary accelerates crack propagation. Processing and forming of a copper tube used in the heat exchange devices involves tube bending, expanding, flaring and other processing methods, which introduces uneven stress distribution in the copper tube. In addition, in the presence of corrosive media (chloride ions, carboxylate ions, or the like), stress corrosion cracking is induced.

In view of the foregoing conventional technology, an alloy component and a preparation process are innovated, so that a high-performance copper alloy with high antibacterial performance and resistance to multiple corrosion has been developed, and has good processing performance, to meet application requirements of complex working conditions such as a sterile environment of medical equipment, high-salt corrosion in marine engineering, and high-pressure cold and hot alternating stress in heat exchange devices.

SUMMARY

An objective of the present disclosure is to provide a corrosion-resistant antibacterial copper alloy, and a preparation method and an application for the same. In the present disclosure, an alloy component is designed and a preparation process is improved, so that a prepared copper alloy has both high antibacterial performance and excellent corrosion resistance, and a service life is long, which can meet a use requirement for a complex working condition.

Currently, a copper alloy generally includes more than five or more than a dozen dopant elements. However, a study in the present disclosure finds that, with an increase in a content of an alloy element, a viscosity of a melt is too high during melting of the alloy, cooling uniformity is reduced, and ingot cracking occurs in a melting casting process. Therefore, it is an important research direction in the copper alloy field to control types of elements as little as possible and maintain better performance.

A first aspect of the present disclosure provides a corrosion-resistant antibacterial copper alloy, including components having the following contents: B: 0.0035-0.055 wt. %; P: 0.15-0.35 wt. %; Si: 0.005-0.05 wt. %; an unavoidable impurity element having a content less than 0.1 wt. %; and a balance being copper. An average grain size of the copper alloy ranges from 4 μm to 7 μm. In the copper alloy, a total proportion of grain boundaries Σ3 and Σ9 satisfies: 60%≤Σ3+Σ9≤ 75%, and a ratio of a proportion of the grain boundary Σ3 to a proportion of the grain boundary Σ9 ranges from 10.5 to 21.0.

Enrichment of trace element B at a grain boundary may reduce active corrosion channels at the grain boundary. When a copper surface is oxidized to form a $Cu_2O$ film, an element B is embedded in a lattice to form B-doped $Cu_2O$, thereby significantly improving compactness and adhesion of an oxide film. In addition, an atomic radius of the element B is small, and may occupy an interstitial position in the $Cu_2O$ lattice, thus blocking a diffusion path of free O. In addition, the element B may enrich an electron state on the copper surface, reducing chemical adsorption energy of chloride ions and carboxylate ions, thereby decreasing initiation of pitting corrosion and improving corrosion resistance of the alloy.

Addition of the element B may reduce a grain size of the copper alloy, increase grain boundaries, and increase a release rate of Cu ions, thereby increasing an antibacterial effect.

When a content of the element B is lower than 0.0035 wt. %, a segregation concentration at the grain boundary is insufficient, and active corrosion channels at the grain boundary cannot be effectively reduced, thus reducing corrosion resistance. In addition, because the content of the element B is too low and a quantity of heteroplasmic nucleation points is reduced, a grain refinement effect cannot be effectively generated, thus weakening antibacterial performance. When the content of the element B is higher than 0.055 wt. %, a Cu—B compound is formed. Formation of a compound reduces molding processability of a material, and also decreases a segregation concentration at the grain boundary of the element B. In addition, a corrosion potential difference is formed between the element B and a surrounding matrix, thus increasing a tendency for pitting corrosion and reducing corrosion resistance. In the present disclosure, the content of the element B is controlled to a value ranging from 0.0035 wt. % to 0.055 wt. % (for example, being 0.035 wt. %, 0.038 wt. %, 0.04 wt. %, 0.042 wt. %, 0.045 wt. %, 0.048 wt. %, 0.05 wt. %, 0.052 wt. %, 0.055 wt. %, or a value in a range formed by any two endpoints), so that both corrosion resistance and antibacterial performance of the alloy may be considered. In an example, the content of the element B ranges from 0.005 wt. % to 0.015 wt. %. In another example, the content of the element B ranges from 0.0135 wt. % to 0.015 wt. %.

The element P may participate in formation of a surface oxide film ($Cu_2O$/CuO), and d orbital electrons of P hybridize with s and p orbital electrons of Cu, to improve resistivity of the film layer. P has a strong affinity with O (a bond energy of the P—O bond is higher than a bond energy of the Cu—O bond). After doping, P forms a stronger covalent bond with surrounding O atoms, which improves a binding force between atoms and inhibits cracks or looseness caused by stress in a film growth process. This helps to improve compactness of the film, and further hinder a corrosion process, thereby improving corrosion resistance. In addition, strong electronegativity of surface P repels H+, weakening hydrogen-induced cracking and improving stress corrosion resistance.

Addition of the element P may reduce a grain size of the copper alloy, increase grain boundaries, and increase a release rate of Cu ions, thereby increasing an antibacterial effect.

When a content of P is less than 0.15 wt. %, a hybridization effect between d orbital electrons of P and s and p orbital electrons of Cu is not good, resulting in an insignificant increase in resistivity of the film layer. Surface P concentration is relatively small, which cannot effectively repel H+, resulting in insignificant improvement of corrosion resistance. When the content of P exceeds 0.35 wt. %, a $Cu_3P$ phase is formed. The $Cu_3P$ phase belongs to a hexagonal crystal, and is a brittle phase in copper, which significantly deteriorates plastic processing performance of the copper alloy. In the present disclosure, when the content of the element P is controlled to a value ranging from 0.15 wt. % to 0.35 wt. % (for example, being 0.15 wt. %, 0.18 wt. %, 0.2 wt. %, 0.22 wt. %, 0.25 wt. %, 0.28 wt. %, 0.3 wt. %, 0.32 wt. %, 0.35 wt. %, or a value in a range formed by any two endpoints), so that both corrosion resistance and plastic processing performance of the alloy may be considered. In an example, the content of the element P ranges from 0.15 wt. % to 0.25 wt. %. In another example, the content of the element P ranges from 0.2 wt. % to 0.25 wt. %.

A negative charge layer of Si repels $H^+$ ions, weakening hydrogen-induced cracking and improving stress corrosion resistance. In addition, there is a synergistic effect between elements Si and P, which effectively prevents diffusion of $H^+$ ions and improves corrosion resistance of the material.

Addition of the element Si may also reduce the grain size of the copper alloy, increase grain boundaries, and increase the release rate of Cu ions, thereby increasing the antibacterial effect.

It should be noted that, an excess of the element B (B>0.005 wt. %) deteriorates fluidity of a melt. In the present disclosure, Si is added to effectively reduce a viscosity of the melt and an interfacial tension while ensuring a grain refinement effect of a B—P composite phase, thereby significantly improving fluidity of the melt and also reducing occurrence of mold sticking. In addition, the elements B—P, serving as an efficient nucleation particle, synergize with the element Si, so that a porosity of an ingot may be reduced, and shrinkage defects may be significantly reduced.

When a content of Si is less than 0.005 wt. %, a surface Si concentration is relatively small, which cannot effectively repel $H^+$, resulting in insignificant improvement of corrosion resistance and fluidity of the ingot. When the content of Si exceeds 0.05 wt. %, a Cu—Si phase is formed, which deteriorates processing performance of the copper material. When the content of the element Si is controlled to a value ranging from 0.005 wt. % to 0.05 wt. % (for example, being 0.005 wt. %, 0.01 wt. %, 0.015 wt. %, 0.02 wt. %, 0.025 wt. %, 0.03 wt. %, 0.035 wt. %, 0.04 wt. %, 0.045 wt. %, 0.05 wt. %, or a value in a range formed by any two endpoints), fluidity of the melt may be improved, casting defects may be improved, and both corrosion resistance and processability can be considered. In an example, the content of the element Si ranges from 0.015 wt. % to 0.05 wt. %. In another example, the content of the element Si ranges from 0.015 wt. % to 0.03 wt. %.

A content of the impurity element is less than 0.1 wt. %, for example, is less than 0.09 wt. %, 0.08 wt. %, 0.07 wt. %, 0.06 wt. %, 0.05 wt. %, 0.04 wt. %, 0.03 wt. %, 0.02 wt. %, 0.01 wt. %, 0.008 wt. %, 0.005 wt. %, or 0.0001 wt. %.

A content of the copper is the balance, that is, 100% minus the contents of the element B, the element P, the element Si, and the impurity element, so that the content of the copper may be obtained through calculation as ranging from 99.445 wt. % to 99.8415 wt. %, for example, may be 99.45 wt. %, 99.535%, 99.55 wt. %, 99.6 wt. %, 99.65 wt. %, 99.7 wt. %, 99.74 wt. %, 99.8%, 99.8415%, or a value in a range formed by any two endpoints.

There is a synergistic effect between the element B, the element P, and the element Si of the present disclosure, and based on the synergistic effect, corrosion resistance and antibacterial performance of the copper alloy may be further improved.

Synergistic Mechanism for Corrosion Resistance:

Synergistic film formation: In the present disclosure, the element B, the element P, and the element Si are added to synergistically form a composite oxide/salt film (the film includes oxides of Cu, B, P, and Si) on a surface in a process of corrosion. The composite film is denser, more stable and more adherent than an oxide film with a single element, and has stronger physical barrier and chemical inertia, which may better hinder a corrosion process.

Defect repair: Oxides of B, P, and Si preferentially deposit or react at weak points (such as dislocation outcrops and inclusions) of the oxide film, which plays a "blocking" role to delay initiation of local corrosion such as pitting corrosion.

Synergistic protection of grain boundary: A strengthening effect of the grain boundary of B complements an effect in reducing oxide inclusion at the grain boundary of P, to jointly improve corrosion resistance of grain boundaries. A synergistic effect of Si and P enhances a hybridization effect with s and p electrons of Cu, increases resistivity of the film, slows down the corrosion rate, and improves the corrosion resistance.

Antibacterial Synergistic Mechanism:

A core mechanism of copper bactericidal action is release of Cu ions. A short-term and high bactericidal rate requires that a sufficient concentration of biotoxic $Cu^+$ ions be released on a surface of the alloy. A synergistic effect of B—P—Si refines a grain size, increases a grain boundary ratio, and also improves a release effect of $Cu^+$ ions. In addition, the synergistic effect of B—P—Si forms a dense oxide film to prevent diffusion of $Cu^+$ ions, thereby ensuring a balance between a bactericidal effect and corrosion resistance.

In an example, in the unavoidable impurity element, a content of oxygen is less than or equal to 0.0010 wt. %. In a copper smelting process, if the content of oxygen in the melt is relatively high and the melt is in contact with hydrogen (such as hydrogen from a furnace gas or hydrogen produced by decomposition of moisture in the raw material), the hydrogen will react with cuprous oxide: $Cu_2O+H_2 \rightarrow 2Cu+H_2O$. The water vapor generated by the reaction forms bubbles during a copper solidification process, resulting in defects such as gas holes and looseness in a casting. In serious cases, the copper alloy is scrapped. In addition, the content of oxygen in the copper alloy is relatively high, which is unfavorable to mechanical performance and corrosion resistance of the copper alloy. Therefore, in the present disclosure, the content of oxygen in the copper alloy needs to be strictly controlled.

In the present disclosure, an average grain size of a copper alloy is controlled to a value ranging from 4 μm to 7 μm (for example, being 4 μm, 4.2 μm, 4.5 μm, 4.8 μm, 5 μm, 5.1 μm, 5.2 μm, 5.3 μm, 5.4 μm, 5.5 μm, 5.6 μm, 5.7 μm, 5.8 μm, 5.9 μm, 6 μm, 6.2 μm, 6.5 μm, 6.8 μm, 7 μm, or a value in a range formed by any two endpoints). Addition of the elements B, P, and Si may enhance a solid solution effect of the Cu matrix, such that internal dislocation density of the alloy is increased under the same deformation conditions, which in turn increases recrystallization driving force, thereby reducing the grain size. On this basis, after a subsequent annealing process, the solid solution elements B, P, and Si hinder migration of grain boundaries, thereby stabilizing the grain size within a relatively small range. When the grain size is reduced to a value less than 7 μm, grain boundaries increase, density of active points on the alloy surface are increased, and a release rate of Cu ions is increased, thereby improving short-term antibacterial efficiency. In an example, the average grain size ranges from 4 μm to 6 μm. In another example, the average grain size ranges from 5.4 μm to 5.9 μm.

In the copper alloy of the present disclosure, a total proportion of the grain boundaries Σ3 and Σ9 satisfies: $60\% \leq \Sigma3+\Sigma9 \leq 75\%$ (for example, being 60%, 61%, 62%, 63%, 64%, 65%, 66%, 67%, 68%, 69%, 70%, 71%, 72%, 73%, 74%, 75%, or a value in a range formed by any two endpoints). In an example, $65\% \leq \Sigma3+\Sigma9 \leq 70\%$. In another example, $66\% \leq \Sigma3+\Sigma9 \leq 69\%$.

In the copper alloy of the present disclosure, a ratio of a proportion of the grain boundary Σ3 to a proportion of the grain boundary Σ9 ranges from 10.5 to 21.0 (for example, being 11, 12, 13, 14, 15, 16, 17, 18, 19, 20, 21, or a value in a range formed by any two endpoints). In an embodiment, a ratio of a proportion of the grain boundary Σ3 to a proportion of the grain boundary Σ9 ranges from 10.5 to 15. In another embodiment, a ratio of a proportion of the grain boundary Σ3 to a proportion of the grain boundary Σ9 ranges from 10.5 to 12.

Addition of the elements B, P, and Si, through synergistic effects of grain boundary segregation, interfacial energy regulation, grain orientation selection, and solid solution-induced lattice distortion, significantly increases a proportion of special grain boundaries (such as coincident site lattice grain boundaries Σ3 and Σ9 and the like) in copper. A core mechanism thereof may be analyzed from the following aspects:

1. Grain Boundary Preferential Segregation and Interfacial Energy Reduction Effect The elements B, P, and Si with high surface activity undergo pronounced grain boundary segregation in a copper-based solid solution (a segregation concentration may reach 10 to 50 times that of the matrix solid solubility), driven by "reduction of interfacial free energy".

Effects of interstitial B: B atoms (with a radius of 0.82 Å), when in the form of an interstitial solid solution, preferentially occupy vacancies or distorted regions at grain boundaries. Through hybridization of 2p orbitals of B with 3d orbitals of Cu, a strong adsorption effect is formed, reducing the grain boundary energy. Since inherent interfacial energy of a special grain boundaries (such as Σ3) is lower than that of ordinary high-angle grain boundaries by 30% to 40%, segregation of B further increases this energy difference, making thermodynamic stability of the special grain boundaries significantly higher than that of the ordinary grain boundaries, and thus the special grain boundaries are preferentially retained during solidification or recrystallization.

Effects of substitutional P and Si: P (with a radius of 1.10 Å) and Si (with a radius of 1.17 Å), when in the form of a substitutional solid solution, form coordinate bonds with Cu atoms at the grain boundaries (3p orbitals of P or 3p orbitals of Si overlap with 3d orbitals of Cu), thereby reducing atomic misfit energy at the grain boundaries. Si and Cu have the same electronegativity of −1.90, and their segregation may further reduce the interfacial energy of the grain boundary Σ3 by about 18%, while segregation of P may also optimize energy of the grain boundaries Σ3 and Σ9.

2. Grain Boundary Migration Suppression and Orientation-Selective Growth

Segregation of solid solution elements at grain boundaries suppresses disorderly migration of grain boundaries through a "pinning effect", and promotes grain growth along low-energy orientations, indirectly increasing a proportion of the special grain boundaries:

Retardation effect of B on grain boundary migration: Interstitial B atoms enriched at grain boundaries form "solute atomic clusters", which significantly increases activation energy for grain boundary migration. This retardation effect facilitates grain growth along the <111> direction (this direction corresponds to formation of twin boundaries of Σ3) during recrystallization.

Orientation regulation by P and Si: The segregation of P may stabilize the Cube texture ({100}<001>), facilitating the formation of the grain boundaries Σ3 and Σ9 between adjacent grains. Si, in the form of a substitutional solid solution, induces slight lattice contraction (about 0.3% to 0.5%), facilitating parallel arrangement of grains along the {111} plane and providing orientation conditions for the formation of the grain boundary Σ3.

3. Diffusion Behavior Modulation and Grain Boundary Structure Ordering

By changing a diffusion coefficient and a path of Cu atoms, solid solution elements promote ordering of atom arrangement at the grain boundaries, thereby providing a structural foundation for the formation of the special grain boundaries.

Effect of B as a fast diffusion channel: A diffusion coefficient of interstitial B atoms at grain boundaries is 3 to 5 orders of magnitude higher than in the matrix. These atoms may rapidly diffuse to fill atomic vacancies at the grain boundaries, reducing disorder and misfit, and causing the grain boundary structure to transform into ordered configurations with low values (for example, Σ3, and Σ9).

Diffusion synergistic effect of Si: An interdiffusion coefficient between Si and Cu at grain boundaries is significantly increased (about 100 times that in the matrix), promoting rearrangement of atoms at the grain boundaries through synergistic diffusion, and enabling ordered arrangement required for coincidence site lattices. First-principles calculation indicates that the solid solution of Si may reduce a degree of atomic misfit of the grain boundary Σ3 by 25% to 30%, and accelerate structural ordering of the Si.

4. Electronic Structure Regulation and Grain Boundary Stability Enhancement

For solid solution elements, electron cloud distribution at grain boundaries is modulated, interatomic bonding force is enhanced, and ordered structures of the special grain boundaries are stabilized as follows:

Electron transfer effect of B: B transfers electrons to 3d orbitals of Cu (about 0.2 to 0.3 electrons per atom), increasing electron cloud density of Cu atoms at the grain boundaries, enhancing interatomic bond energy, and inhibiting transformation of the special grain boundaries into higher-Σ boundaries.

Orbital hybridization effect of P and Si: When 3p orbitals of P form coordinate bonds with 3d orbitals of Cu, electron cloud distribution becomes directional, enhancing anisotropy of atomic arrangement at the grain boundaries and improving shear resistance of the grain boundary Σ9. Si, through electronegativity-driven hybridization with Cu, makes the electron cloud distribution at the grain boundaries more uniform, reducing local charge imbalance, and further stabilizing the twin structure of the grain boundary Σ3.

The grain boundaries Σ3 and Σ9 exhibit excellent thermodynamic stability due to their uniquely low interfacial energy characteristics (only about 1/30 of ordinary random grain boundaries) and highly coherent structural characteristics. From a microstructural perspective, these special grain boundaries exhibit highly ordered atomic arrangement, making them less likely to serve as active points for corrosion reactions. In addition, there is a small difference in electric potential between the grain boundary Σ3 or Σ9 and the grain interior, which may mitigate a micro-galvanic effect in the grain interior and at the grain boundaries, thereby extending a diffusion path of corrosive media and significantly slowing down depthwise progression of corrosion. When the total proportion of grain boundaries Σ3 and Σ9 is less than 60%, improvement of the corrosion resistance of the alloy is insignificant. When the total proportion is greater than 75%, active points on the alloy surface are reduced, resulting in reduced antibacterial performance. In the present disclosure, the total proportion of grain boundaries Σ3 and Σ9 is controlled in the range described above, enabling the alloy to exhibit excellent corrosion resistance while maintaining antibacterial performance.

In an example, the antibacterial performance of the copper alloy may be manifested as follows: 15-minute bactericidal rate ≥70%.

In an example, the corrosion resistance of the copper alloy may be manifested as follows: a maximum corrosion depth is less than or equal to 44 μm after 30 days of alternate cold and hot corrosion in a 0.1% formic acid aqueous solution environment.

In an example, the corrosion resistance of the copper alloy may be manifested as follows: a corrosion weight loss rate is less than or equal to $9.5\times10^{-5}$ g/h after exposure to a neutral salt spray environment for 480 h.

In an example, the corrosion resistance of the copper alloy may be manifested as follows: duration for resistance to stress corrosion leakage is greater than or equal to 80 days.

In an example, in the copper alloy, a content of B ranges from 0.005 wt. % to 0.015 wt. %; a content of P ranges from 0.15 wt. % to 0.25 wt. %; a content of Si ranges from 0.01 wt. % to 0.03 wt. %; an average grain size of the copper alloy ranges from 4.0 μm to 6.0 μm; and a total proportion of grain boundaries Σ3 and Σ9 satisfies: 65%≤Σ3+Σ9≤75%. In the present disclosure, contents of the elements B, P, and Si are optimized, so that the corrosion resistance and antibacterial performance of the copper alloy may be regulated. Under this condition, the 15-minute bactericidal rate of the alloy is greater than or equal to 70%; the maximum corrosion depth is less than or equal to 35 μm after 30 days of alternate cold and hot corrosion in the 0.1% formic acid aqueous solution environment; the corrosion weight loss rate is less than or equal to $7.0\times10^{-5}$ g/h after exposure to the neutral salt spray environment for 480 h; and the duration for resistance to stress corrosion leakage is greater than or equal to 100 days.

In an example, a total content of B and P in the copper alloy ranges from 0.15 wt. % to 0.4 wt. %, for example, is 0.15 wt. %, 0.18 wt. %, 0.2 wt. %, 0.21 wt. %, 0.22 wt. %, 0.23 wt. %, 0.24 wt. %, 0.25 wt. %, 0.26 wt. %, 0.27 wt. %, 0.28 wt. %, 0.29 wt. %, 0.3 wt. %, 0.32 wt. %, 0.35 wt. %, 0.38 wt. %, 0.4 wt. %, or a value in a range formed by any two endpoints. In an example, a total content of B and P in the copper alloy ranges from 0.2 wt. % to 0.26 wt. %.

In an example, a mass ratio of the element B to the element P in the copper alloy satisfies: 0.03≤B/P≤0.2, for example, is 0.03, 0.04, 0.045, 0.05, 0.055, 0.06, 0.065, 0.07, 0.08, 0.09, 0.1, 0.12, 0.15, 0.18, 0.2, or a value in a range formed by any two endpoints. In an example, a mass ratio of the element B to the element P in the copper alloy satisfies: 0.04≤B/P≤0.07.

In an embodiment, a mass ratio of Si to a total mass of B and P in the copper alloy satisfies: 0.01≤Si/(B+P)≤0.35, for example, is 0.01, 0.03, 0.06, 0.10, 0.13, 0.16, 0.20, 0.23, 0.26, 0.30, 0.32, or 0.35. In an embodiment, a mass ratio of Si to a total mass of B and P in the copper alloy satisfies: 0.05≤Si/(B+P)≤0.15.

In an example, in the copper alloy, a total content of B and P ranges from 0.20 wt. % to 0.26 wt. %; a mass ratio of the element B to the element P satisfies: 0.04≤B/P≤0.07; a mass ratio of the element Si to a total mass of the elements B and P satisfies: 0.06≤Si/(B+P)≤0.15; an average grain size of the copper alloy ranges from 4.0 μm to 5.8 μm; and a total proportion of grain boundaries Σ3 and Σ9 satisfies: 67%≤Σ3+Σ9≤75%.

In the present disclosure, a content and a proportion of elements B, P, and Si are further limited, so that corrosion resistance of a copper alloy can be further improved on a basis of maintaining excellent antibacterial performance. In this condition, the 15-minute bactericidal rate of the alloy is greater than or equal to 70%; the maximum corrosion depth is less than or equal to 30 μm after 30 days of alternate cold and hot corrosion in the 0.1% formic acid aqueous solution environment; the corrosion weight loss rate is less than or equal to $6.0\times10^{-5}$ g/h after exposure to the neutral salt spray environment for 480 h; and the duration for resistance to stress corrosion leakage is greater than or equal to 103 days. Therefore, the copper alloy is applicable to harsh service environments such as marine engineering components and heat exchange devices.

In an example, an outer surface of the copper alloy further has an oxide film layer, the oxide film layer is formed by oxidizing the copper alloy, and a thickness of the oxide film layer ranges from 0.20 μm to 0.95 μm (for example, being 0.2 μm, 0.25 μm, 0.3 μm, 0.35 μm, 0.4 μm, 0.45μ, 0.5μ, 0.55 μm, 0.6 μm, 0.65 μm, 0.7 μm, 0.75 μm, 0.8 μm, 0.85 μm, 0.9 μm, 0.95 μm, or a value in a range formed by any two endpoints). In an example, the thickness ranges from 0.3 μm to 0.8 μm. The oxide film layer contains oxides of B, P, and Si. A content of O ranges from 16 wt. % to 24 wt. % (for example, being 16 wt. %, 17 wt. %, 18 wt. %, 19 wt. %, 20 wt. %, 21 wt. %, 22 wt. %, 23 wt. %, 24 wt. %, or a value in a range formed by any two endpoints). A content of B ranges from 0.60 wt. % to 0.90 wt. % (for example, being 0.6 wt. %, 0.65 wt. %, 0.7 wt. %, 0.75 wt. %, 0.8 wt. %, 0.85 wt. %, 0.9 wt. %, or a value in a range formed by any two endpoints). A content of P ranges from 0.03 wt. % to 0.05 wt. % (for example, being 0.03 wt. %, 0.032 wt. %, 0.035 wt. %, 0.038 wt. %, 0.04 wt. %, 0.042 wt. %, 0.045 wt. %, 0.048 wt. %, 0.05 wt. %, or a value in a range formed by any two endpoints). A content of Si ranges from 0.10 wt. % to 0.13 wt. % (for example, being 0.10 wt. %, 0.105 wt. %, 0.11 wt. %, 0.115 wt. %, 0.12 wt. %, 0.125 wt. %, 0.13 wt. %, or a value in a range formed by any two endpoints).

In the present disclosure, the thickness of the oxide film layer and the contents of the elements B, P, Si, and O in the film layer are controlled within the ranges described above, thereby significantly improving the corrosion resistance of the copper alloy.

In the present disclosure, a method for detecting contents of elements is as follows: for point (Point) of energy spectrum data, energy spectrum data from at least three points per image are collected, and an average value of the data from these points is used as an element content detection result.

If the thickness of the film layer is less than 0.20 μm, improvement in the corrosion resistance is insignificant. If the thickness of the film layer is greater than 0.95 μm, the relatively thick oxide film layer serves as a diffusion barrier, which impedes diffusion of Cu ions, and weakens a contact effect between Cu ions on the alloy surface and bacteria, consequently reducing the antibacterial performance.

The element B may facilitate the formation of a continuous and dense oxide film. The element P further improves compactness of the oxide film through its oxides and enhances adhesion between the film and the matrix. In addition, there is a synergistic effect between the elements P and B, and their combined action increases the thickness of the film. The element Si is uniformly doped into $Cu_2O$ in the form of oxides, such that the structure of the oxide film is denser and more complete. In the present disclosure, the contents of the elements B, P, Si, and O are controlled within the ranges described above, so that the continuity and compactness of the oxide film and its adhesion to the matrix are all improved. Higher compactness of the oxide film layer indicates greater adhesion to the matrix and higher stability of the film layer, thereby more effectively preventing penetration of corrosive media, and significantly improving the corrosion resistance of the alloy.

The element B significantly improves the compactness of the oxide film by suppressing disordered diffusion of ions and optimizing the microstructure of the oxide film.

a. Suppression of Pore Formation Via Grain Boundary Segregation

B atoms preferentially segregate at grain boundaries of copper, reducing the grain boundary energy and blocking fast diffusion channels of Cu and O ions. During oxidation, atomic migration becomes more uniform, avoiding formation of columnar grains caused by directional diffusion (which easily generates intergranular pores), and instead causing equiaxed oxide particles ($Cu_2O$) to be formed. These particles pack tightly, leading to reduced overall porosity compared to pure Cu.

B. Regulation of Growth Kinetics Via the Interstitial Solid Solution

When in the form of an interstitial solid solution, the element B improves diffusion activation energy of Cu atoms, reduces an oxidation rate, and reduces local growth differences. In addition, B transfers electrons to 3d orbitals of Cu, which enhances the Cu—O bond energy, promotes the uniform and dense growth of the oxide film, leading to a reduced thickness distribution deviation of the film layer compared to pure Cu.

Composite Addition of B and P: Oxide Film Thickening and Corrosion Resistance Enhancement Mechanism The synergistic effect of P and B accelerates the oxidation reaction and optimizes the structural integrity of the film layer, so that the thickness of the oxide film is increased, and the corrosion resistance is superior to that achieved by B alone.

a. Promotion of Film Layer Thickening Via the Catalytic Effect of p 3p orbitals of P strongly hybridize with 2p orbitals of O, lowering an adsorption energy barrier of $O_2$ on the surface and accelerating dissociation and diffusion of O ions. In addition, P has higher electronegativity than Cu, which promotes migration of Cu ions toward the surface of the oxide film via electrostatic attraction, thereby increasing an overall growth rate and leading to an increase in the thickness compared to that obtained with B alone.

b. Enhancement of Structural Stability Via the Synergistic Effect of B and P

B maintains the compactness of the film layer, while P mitigates lattice strain in the oxide film through substitutional solid solution, reducing microcracks caused by thermal stress. Charge transfer resistance (Rct) of the B—P film layer is increased compared to that obtained with B alone, and the resistance to corrosive ion penetration is enhanced.

Composite Addition of B, P, and Si: Mechanism for a Maximum Oxide Film Thickness and Optimal Corrosion Resistance After introduction of Si, a synergistic effect is established among Si, B, and P. By reinforcing synergistic diffusion and enhancing the chemical stability of the film layer, the oxide film thickness and corrosion resistance are maximized.

a. Enhancement of Oxidation Growth Kinetics Via Si 3p orbitals of Si exhibit stronger hybridization with 2p orbitals of O than P, further lowering the adsorption energy barrier of $O_2$. In addition, an interdiffusion coefficient between Si and Cu is increased, accelerating atomic migration. The synergy among the three further increases a growth rate of the oxide film compared to the B+P combination, achieving the maximum thickness.

b. Improvement of the Overall Stability of the Film Layer Via the Composite Solid Solution Si induces lattice contraction (0.3% to 0.5%) through substitutional solid solution, leading to denser atomic arrangement in the oxide film and further reduction in porosity. Si ions partially replace Cu ions to form a Cu—Si—O solid solution region (distributed throughout the oxide film). Since the bond energy of the Si—O is higher than the bond energy of the Cu—O, the chemical stability of the film layer is significantly improved.

c. Synergistic Enhancement of Corrosion Resistance by the Elements

Physical barrier reinforcement: The thickest film layer and low porosity jointly prevent penetration of corrosive ions.

Improved electrochemical stability: The breakdown potential of the oxide film is higher than that of the B+P combination, enhancing resistance to pitting corrosion.

Optimization of film-matrix adhesion: The synergistic effect between P and Si reduces interfacial stress between the film layer and the matrix, increasing the bonding energy, and reducing a risk of film delamination during corrosion.

In conclusion, the solid-solution-state B, P, and Si exhibit a pronounced synergistic effect on regulating the oxide film formed on the copper surface:

B primarily contributes to film densification by suppressing diffusion and promoting uniform growth to reduce porosity.

P promotes film thickening and stress relief by catalyzing oxidation and regulating lattice strain to increase the thickness and reduce cracks.

Si enhances the overall stability by improving the bond energy and compactness to improve the chemical stability of the film.

The synergy among the three achieves an optimal balance between thickness, compactness, and stability of the oxide film, providing a theoretical basis for multi-element synergistic regulation in the corrosion-resistant design of copper-based materials.

In an example, an average grain size of the copper alloy including an oxide film layer ranges from 4 μm to 7 μm. A total proportion of grain boundaries Σ3 and Σ9 satisfies: $60\% \leq \Sigma3+\Sigma9 \leq 75\%$, and a ratio of a proportion of the grain boundary Σ3 to a proportion of the grain boundary Σ9 ranges from 10.5 to 21.0.

It should be noted that a grain size and a proportion of a special grain boundary of an alloy will not be changed by performing oxidation treatment on the annealed copper alloy to form an oxide film. In the present disclosure, controlling the grain size and the proportion of the special grain boundary in the foregoing ranges may ensure stability of a structure of the copper alloy, and further obtaining a more stable short-term bactericidal effect and corrosion resistance effect.

In an example, a 15-minute bactericidal rate of the copper alloy including an oxide film layer is greater than or equal to 70%; a maximum corrosion depth is less than or equal to 16 μm after 30 days of alternate cold and hot corrosion in a 0.1% formic acid aqueous solution environment; a corrosion weight loss rate is less than or equal to $5.0\times10^{-5}$ g/h after exposure to a neutral salt spray environment for 480 h; and duration for resistance to stress corrosion leakage is greater than or equal to 115 days. Therefore, the copper alloy is applicable to harsh service environments such as marine engineering components and heat exchange devices.

A second aspect of the present disclosure provides a preparation method for the corrosion-resistant antibacterial copper alloy, including: batching and smelting→horizontal continuous casting→milling→planetary rolling→coil drawing→online annealing→internal thread forming→rewinding and splitting→finished product annealing.

A total cross-sectional reduction rate of the planetary rolling+coil drawing+inner grooving ranges from 96.80% to 99.95% (for example, being 96.8%, 97%, 97.2%, 97.5%, 97.8%, 98%, 98.2%, 98.5%, 98.8%, 99%, 99.2%, 99.5%, 99.8%, 99.95%, or a value in a range formed by any two of these values).

A temperature of the online annealing ranges from 590° C. to 620° C. (for example, being 590° C., 600° C., 610° C., 620° C. or a value in a range formed by any two of these values), and a feed rate ranges from 350 m/min to 420 m/min (for example, being 350 m/min, 360 m/min, 370 m/min, 380 m/min, 390 m/min, 400 m/min, 410 m/min, 420 m/min, or a value in a range formed by any two of these values).

A temperature of the finished product annealing ranges from 500° C. to 560° C. (for example, being 500° C., 510° C., 520° C., 530° C., 540° C., 550° C., 560° C., or a value in a range formed by any two of these values), and annealing duration ranges from 20 minutes to 50 minutes (for example, being 20 min, 25 min, 30 min, 35 min, 40 min, 45 min, 50 min, or a value in a range formed by any two of these values).

In the present disclosure, on the basis of alloy composition, ultra-high cross-sectional reduction rate is used, high-density dislocation and deformation zones are introduced, and a proportion of easy-to-form special textures (such as Cube and Brass), to promote dynamic recrystallization; In addition, in combination with a subsequent annealing process, a microstructure of an alloy is adjusted, a grain size of the alloy is refined, and proportions of special grain boundaries o 3 and o 9 are optimized, thereby obtaining a copper alloy with excellent corrosion resistance and antibacterial performance.

In an example, in a process of the batching and smelting, raw materials meeting a target composition are smelted, and a smelting temperature ranges from 1120° C. to 1250° C. (for example, being 1120° C., 1140° C., 1160° C., 1180° C., 1200° C., 1220° C., 1240° C., 1250° C., a value in a range formed by any two of these values), and charcoal is used to cover a copper liquid surface.

In an example, in the smelting process, a Cu—P intermediate alloy is added first, then a Cu—B intermediate alloy is added, and finally a Cu—Si intermediate alloy is added.

B, P, and Si are all thermodynamically more easily combined with oxygen than Cu (Standard electrode potentials of B, P, and Si are all lower than a standard electrode potential of Cu, for example, an electrode potential of Si is −0.14V, an electrode potential of B is −0.89 V, an electrode potential of P is −0.276 V, and all of them are lower than +0.337V for $Cu_2$+/Cu). Based on this characteristic, the addition of the elements B, P and Si is helpful to control an oxygen content in the copper matrix during casting, and the oxygen content in an ingot can be controlled below 0.0010 wt. % by combining with conventional carbon covering.

In an example, in the horizontal continuous casting process, a casting temperature ranges from 1150° C. to 1180° C. (for example, being 1150° C., 1160° C., 1170° C., 1180° C., or a value in a range formed by any two of these values). A traction speed ranges from 280 mm/min to 420 mm/min (for example, being 280 mm/min, 300 mm/min, 320 mm/min, 340 mm/min, 360 mm/min, 380 mm/min, 400 mm/min, 420 mm/min, or a value in a range formed by any two of these values). An inlet flow rate of cooling water ranges from 25 L/min to 50 L/min (for example, being 25 L/min, 30 L/min, 35 L/min, 40 L/min, 45 L/min, 50 L/min, or a value in a range formed by any two of these values), and a temperature difference between inlet and outlet water is controlled in a range of 15-20° C. (for example, being 15° C., 16° C., 17° C., 18° C., 19° C., 20° C., or a value in a range formed by any two of these values).

In an example, to ensure uniform removal of an oxide layer from a surface of an ingot, the ingot needs to be straightened before the milling.

In an example, in a process of the planetary rolling, a feed speed ranges from 1.8 m/s to 2.5 m/s (for example, being 1.8 m/s, 1.9 m/s, 2.0 m/s, 2.1 m/s, 2.2 m/s, 2.3 m/s, 2.4 m/s, 2.5 m/s, or a value in a range formed by any two of these values). A discharge speed ranges from 20 m/s to 30 m/s (for example, being 20 m/s, 22 m/s, 24 m/s, 26 m/s, 28 m/s, 30 m/s, or a value in a range formed by any two of these values). A deformation rate is controlled at a value ranging from 85% to 92% (for example, being 85%, 86%, 87%, 88%, 89%, 90%, 91%, 92%, or a value in a range formed by any two of these values). In a process of the planetary rolling, a high deformation rate may trigger dynamic recrystallization. A proportion of recrystallization texture is adjusted, to make the grain size significantly refined and grain boundaries increased, so that a release rate of Cu ions is increased, and an antibacterial effect is improved.

In an example, in order to eliminate spiral patterns of planetary rolling, at least three passes of coil drawing processing are performed, and an elongation coefficient for first two passes is controlled at a value ranging from 1.5 to 1.7 (for example, being 1.5, 1.55, 1.6, 1.65, 1.7, or a value in a range formed by any two of these values), and an elongation coefficient for a subsequent pass is controlled at a value ranging from 1.3 to 1.5 (for example, being 1.3, 1.35, 1.4, 1.45, 1.5, or a value in a range formed by any two of these values).

Spiral patterns may remain on the surface of the material after planetary rolling (formed by rotary rolling of a planetary roller), and stress distribution in these pattern regions is uneven, which will become starting points of corrosion or an adhesion region of bacteria. Multi-pass coil drawing (≥3 passes) may gradually eliminate the surface pattern defects, making the stress distribution in the rolling pattern region even and reducing corrosion sensitivity.

According to the present disclosure, the elongation coefficient of the first two passes is controlled at a value ranging from 1.5 to 1.7, and the high elongation coefficient makes the metal on the surface of the material flow more fully, covers original rolling patterns, and also promotes further refinement of grains. Then the elongation coefficient in the following pass is controlled at a value ranging from 1.3 to 1.5. A lower elongation coefficient may avoid excessive work hardening, improve surface smoothness of the material, avoid surface microcracks, reduce adsorption of a corrosive medium, and also promote uniform distribution of internal stress of the material, thereby avoiding a tendency to local electrochemical corrosion. In addition, the elimination of spiral patterns may reduce surface roughness of the material, thereby reducing the bacterial attachment points, and further improving antibacterial performance of the material.

In the present disclosure, a temperature of the online annealing ranges from 590° C. to 620° C., and a feed rate ranges from 350 m/min to 420 m/min. According to the present disclosure, the on-line annealing temperature is controlled, so that complete recrystallization may be triggered, thereby eliminating work hardening and avoiding excessive growth of crystal grains. In addition, in combination with the feeding rate, a tube blank passes through an induction heating zone at the best rate, which ensures a full recrystallization process, forms a fine grain strengthening effect, and reduces a stress concentration phenomenon caused by uneven distribution of grains, thereby avoiding stress corrosion cracking. In addition, in the present disclosure, the annealing temperature and the feed rate are accurately and cooperatively controlled, so that a special texture (such as Cube\Brass) proportion may be easily formed to improve a special grain boundary proportion, and surface carbide deposition may be reduced, thereby reducing a risk of bacterial biofilm attachment.

In an example, in a process of the internal thread forming, a forming rate ranges from 35 m/min to 50m/min (for example, being 35 m/min, 40 m/min, 45 m/min, 50 m/min, or a value in a range formed by any two of these values), an equivalent cold working deformation ranges from 15% to 20% (for example, being 15%, 16%, 17%, 18%, 19%, 20%, or a value in a range formed by any two of these values), and an elongation coefficient ranges from 1.15 to 1.25 (for example, being 1.15, 1.16, 1.17, 1.18, 1.19, 1.20, 1.21, 1.22, 1.23, 1.24, 1.25, or a value in a range formed by any two of these values). In the present disclosure, controlling the forming rate at a value ranging from 35 m/min to 50m/min (for example, being 35 m/min, 38 m/min, 40 m/min, 42 m/min, 45 m/min, 48 m/min, 50 m/min, or a value in a range formed by any two of these values) may ensure uniformity and integrity of tooth shapes of an internal threaded copper tube. The cold working deformation is controlled at a value ranging from 15% to 20%, and a proper dislocation density is accumulated in the material, which provides favorable texture orientation for forming uniform fine recrystallization grains and specific proportions of special grain boundaries through the finished product annealing. The elongation coefficient is controlled at a value ranging from 1.15 to 1.25, so as to reduce mechanical wear of thread grooves, thereby avoiding microcracks. The foregoing measures provide favorable conditions for the material to form a more uniform and fine grain size and higher proportions of the special grain boundaries while ensuring material processability. It may be understood that, when internal thread tubes with different sizes are prepared, an internal thread forming parameter may be adjusted according to an actual requirement.

In an example, in a process of the rewinding and splitting, a rewinding rate ranges from 150 m/min to 350 m/min (for example, being 150 m/min, 180 m/min, 200 m/min, 220 m/min, 250 m/min, 280 m/min, 300 m/min, 320 m/min, 350 m/min, or a value in a range formed by any two of these values), and the finished product annealing is performed after rewinding.

In the present disclosure, the finished product annealing is performed in an inert atmosphere, and an annealing temperature ranges from 500° C. to 560° C. (for example, being 500° C., 510° C., 520° C., 530° C., 540° C., 550° C., 560° C., or a value in a range formed by any two of these values), and annealing duration ranges from 20 min to 50 min (for example, being 20 min, 30 min, 40 min, 50 min, or a value in a range formed by any two of these values). If the annealing temperature is less than 500° C., the stress is not eliminated completely. Residual stress may result in a local electrochemical potential difference and form a stress corrosion sensitive region. If the annealing temperature is higher than 560° C., a grain growth driving force increases, which results in grain coarsening, and grain boundary density decreases, thus forming long-range continuous corrosion channels. Matching of the annealing duration and the annealing temperature may ensure that stress release accumulated in former deformation pass is completed. If the annealing duration is less than 20 min, the stress elimination is incomplete, resulting in an uneven structure and local corrosion risks. If the annealing duration is higher than 50 min, excessive grain growth may be caused in the grain growth-dominated stage, which will adversely affect corrosion resistance and antibacterial performance.

According to the present disclosure, the temperature and duration of finished product annealing are controlled in the foregoing range, so that processing stress may be eliminated, thereby avoiding local corrosion sensitivity caused by stress concentration; and in addition, grain overgrowth may be avoided to ensure moderate grain boundary density (reduce corrosion channels) and maintain sufficient mechanical performance, and sufficient proportions of the special grain boundaries can be formed to increase corrosion resistance of the finished product.

In an example, after the process of the finished product annealing, the preparation method for the copper alloy further includes a process of oxidation treatment, and a step of the oxidation treatment is as follows: after finished product annealing, when a temperature in a furnace drops to 50-100° C. (for example, being 50° C., 60° C., 70° C., 80° C., 90° C., 100° C., or a value in a range formed by any two of these values), removing a prepared product from the furnace and placing the prepared product in an oxygen-containing gas to cool to room temperature, and controlling a cooling rate at a value ranging from 5° C./min to 10° C./min (for example, being 5° C./min, 6° C./min, 7° C./min, 8° C./min, 9° C./min, 10° C./min, or a value in a range formed by any two of these values). The oxygen-containing gas is a mixture of oxygen and an inert gas, and a volume proportion of oxygen in the mixture is controlled at a value ranging from 25% to 35% (for example, being 25%, 26%, 27%, 28%, 29%, 30%, 31%, 32%, 33%, 34%, 35%, or a value in a range formed by any two of these values). After the foregoing processing, a copper alloy with a continuous dense oxide film layer may be obtained.

In the present disclosure, the oxidation treatment is performed on the after copper alloy product obtained after the finished product annealing. When the alloy surface is in contact with oxygen, oxyphilic elements (B, P, and Si) in the alloy will migrate to the surface of the copper alloy through diffusion, and react with O to form an oxide film, which results in enrichment of oxyphilic elements on the surface of the material.

When a temperature of the oxidation treatment is lower than 50° C., diffusion rates of the oxyphilic elements decrease rapidly at low temperature, and the oxyphilic elements cannot effectively migrate to the surface, resulting in uneven oxide film composition and poor film compactness. In addition, the oxide film formed at low temperature has a weak binding force to the substrate, and is prone to be peeled off during mechanical processing. When a temperature of the oxidation treatment is higher than 100° C., the oxidation may be out of control. A surface of the prepared copper alloy product will be blackened, and peeling and wrinkling may occur during tube bending, tube expanding, and tube flaring.

When a cooling rate is lower than 5° C./min, the alloy is exposed to an oxygen environment for a long time, and thus the oxide film is continuously thickened and even a layered structure is formed. When a cooling rate is higher than 10° C./min, rapid cooling causes mismatch between shrinkage of the oxide film and the matrix, resulting in microcracks and segregation of components.

When a volume proportion of oxygen in an oxygen-containing gas is less than 25%, insufficient migration driving force of oxyphilic elements (B, P, and Si) may be caused, and coverage of the surface oxide film is low and discontinuous, thus forming a local bare region that becomes a corrosion start point. When a volume proportion of oxygen in the oxygen-containing gas is greater than 35%, excessive oxidation may occur. The copper tube surface is blackened and a formed oxide film is too thick, which reduces surface cleanliness and increases internal stress. In this case, peeling may easily occur in subsequent tube bending/expanding or the like.

According to the present disclosure, an oxidation process is controlled by controlling the temperature of the oxidation treatment, the cooling rate, and the oxidation atmosphere, so that the thickness, the compactness, and the element content of the oxide film (the oxide film layer) are controlled in a proper range, to make corrosion resistance of the prepared copper alloy product improved based on excellent antibacterial performance.

It should be noted that the components of the copper alloy provided in the present disclosure are not only applicable to production of pipes, but also applicable to preparation of various copper alloy products such as wires, bars, plates, strips, profiles, or the like. The production process may not only adopt an existing mature processing technology, but also optimize and adjust a process parameter or develop a new processing method according to specific requirements for product performance and application scenarios, so as to meet diversified demands of different industries for copper alloy materials.

A third aspect of the present disclosure further provides an application of the corrosion-resistant antibacterial copper alloy in a field such as medical equipment, marine engineering, heat exchange devices, or sanitary equipment. The copper alloy of the present disclosure has high antibacterial performance and excellent resistance to multiple corrosion, and has a long service life, so that the copper alloy is particularly applicable to a compound operating condition such as a sterile environment of medical equipment, high-salt corrosion in marine engineering, or high-pressure cold and hot alternating stress in heat exchange devices.

Compared with the conventional technology, the present disclosure has at least the following beneficial effects:

(1) In the present disclosure, non-metal elements B, Si, and P are used and proportions of the non-metal elements B, Si, and P are adjusted. With reference to a preparation process, a copper alloy having both corrosion resistance and antibacterial performance may be obtained. A 15-minute bactericidal rate of the copper alloy is greater than or equal to 70%; a maximum corrosion depth is less than or equal to 44 μm after 30 days of alternate cold and hot corrosion in a 0.1% formic acid aqueous solution environment; a corrosion weight loss rate is less than or equal to $9.5\times10^{-5}$ g/h after exposure to a neutral salt spray environment for 480 h; and duration for resistance to stress corrosion leakage is greater than or equal to 80 days.

(2) In the present disclosure, a process is further improved on the basis of an alloy component. After finished product annealing, oxidation treatment is performed on the obtained copper alloy, and an oxide film layer is formed on a surface of the copper alloy, so that corrosion resistance of the copper alloy may be greatly improved in a case that antibacterial performance of the copper alloy meets a requirement. The 15-minute bactericidal rate of the copper alloy is greater than or equal to 70%; the maximum corrosion depth is less than or equal to 16 μm after 30 days of alternate cold and hot corrosion in a 0.1% formic acid aqueous solution environment; the corrosion weight loss rate is less than or equal to $5.0\times10^{-5}$ g/h after exposure to the neutral salt spray environment for 480 h; and the duration for resistance to stress corrosion leakage is greater than or equal to 115 days.

(3) The copper alloy of the present disclosure has high antibacterial performance and excellent corrosion resistance, and has a long service life, so that the copper alloy prospects in a compound working condition such as a sterile environment of medical equipment, high-salt corrosion in marine engineering, or high-pressure cold and hot alternating stress in heat exchange devices.

BRIEF DESCRIPTION OF THE DRAWINGS (a) of FIG. 1 is a metallographic diagram of ant-nest corrosion in Comparative Example 1.

(b) of FIG. 1 is a metallographic diagram of ant-nest corrosion in Comparative Example 2.

(c) of FIG. 1 is a metallographic diagram of ant-nest corrosion in Comparative Example 3.

(d) of FIG. 1 is a metallographic diagram of ant-nest corrosion in Comparative Example 6.

(e) of FIG. 1 is a metallographic diagram of ant-nest corrosion in Comparative Example 8.

(f) of FIG. 1 is a metallographic diagram of ant-nest corrosion in Comparative Example 9.

(g) of FIG. 1 is a metallographic diagram of ant-nest corrosion in Example 4.

(h) of FIG. 1 is a metallographic diagram of ant-nest corrosion in Example 5.

(i) of FIG. 1 is a metallographic diagram of ant-nest corrosion in Example 7.

Figure 2:
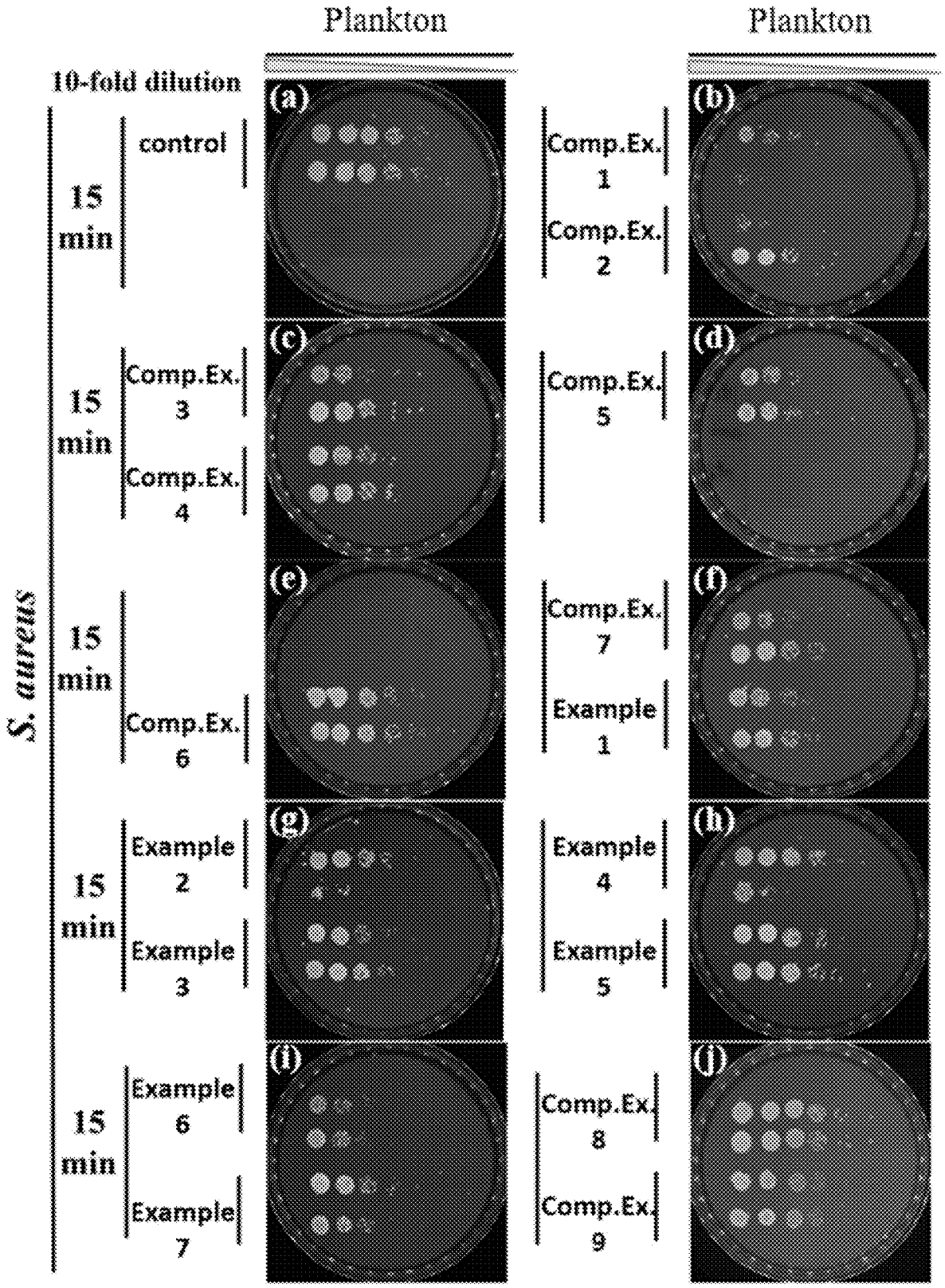

(a) of FIG. 2 is a diagram of bactericidal effects of Control, where Control refers to a sample solution without adding a tube sample.

(b) of FIG. 2 is a diagram of bactericidal effects in Comparative Examples 1 and 2.

(c) of FIG. 2 is a diagram of bactericidal effects in Comparative Examples 3 and 4.

(d) of FIG. 2 is a diagram of bactericidal effect in Comparative Example 5.

(e) of FIG. 2 is a diagram of bactericidal effect in Comparative Example 6.

(f) of FIG. 2 is a diagram of bactericidal effects in Comparative Example 7 and Example 1.

(g) of FIG. 2 is a diagram of bactericidal effects in Examples 2 and 3.

(h) of FIG. 2 is a diagram of bactericidal effects in Examples 4 and 5.

(i) of FIG. 2 is a diagram of bactericidal effects in Examples 6 and 7.

(j) of FIG. 2 is a diagram of bactericidal effects in Comparative Examples 8 and 9.

Figure 3:
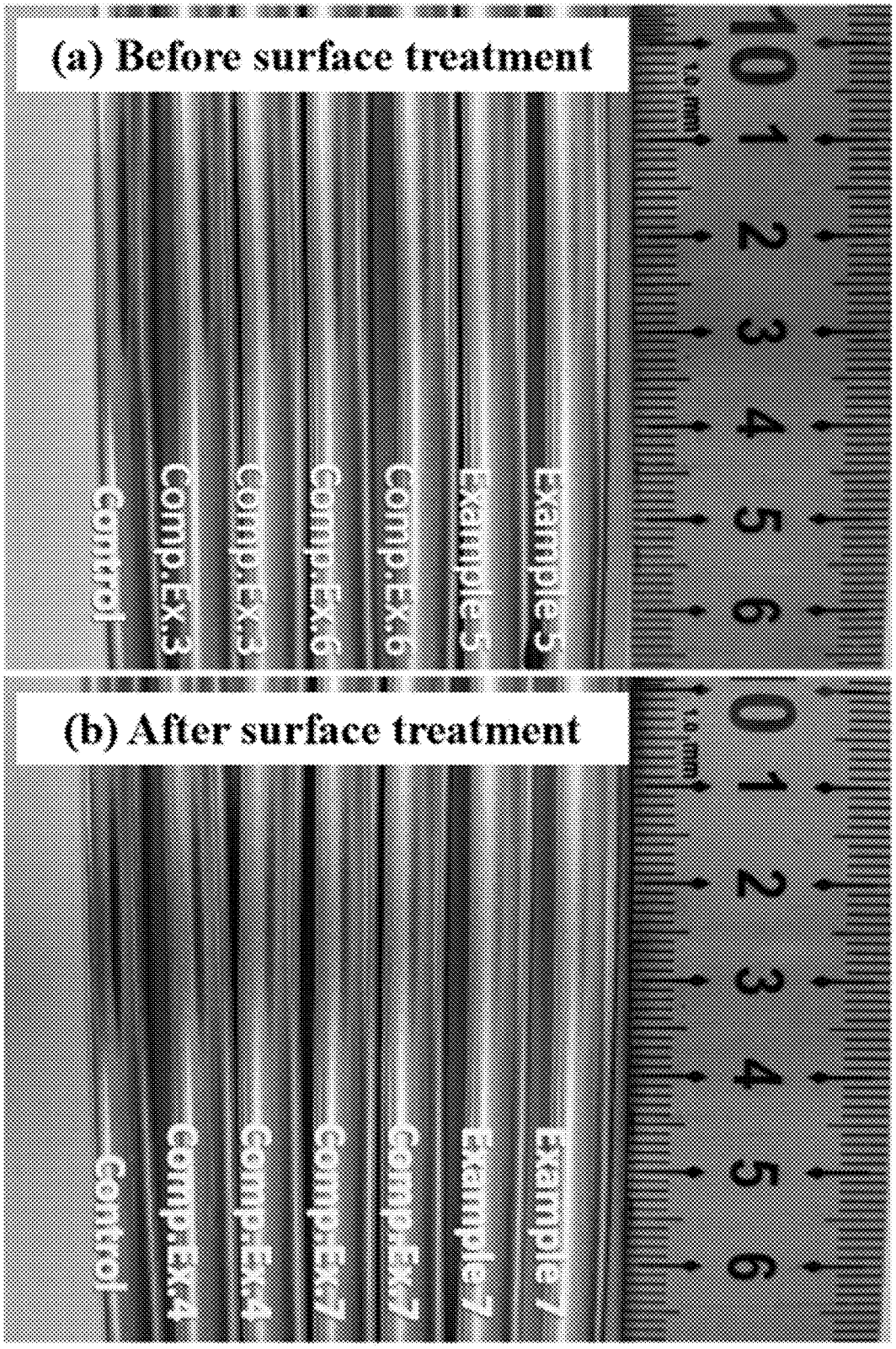

(a) of FIG. 3 shows photos of alloy surfaces before surface treatment in Control, Comparative Example 3, Comparative Example 6 and Example 5, where Control refers to a copper material with a common model being TP2.

(b) of FIG. 3 shows photos of alloy surfaces before surface treatment in Control, Comparative Example 4, Comparative Example 7 and Example 7, where Control refers to TP2.

Figure 4:
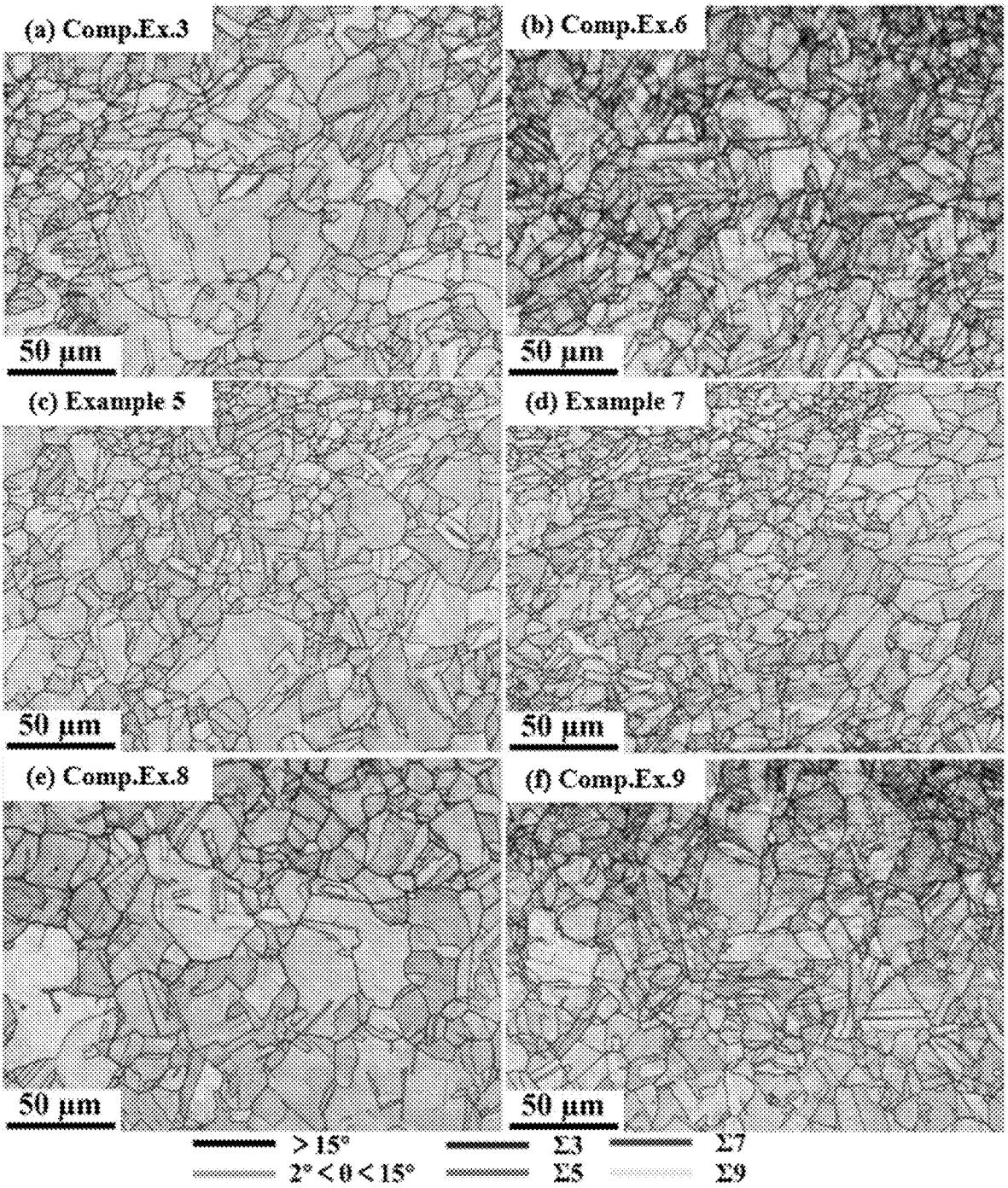

(a) of FIG. 4 is a diagram of electron backscatter diffraction (EBSD) characterization result for Comparative Example 3.

(b) of FIG. 4 is a diagram of electron backscatter diffraction (EBSD) characterization result for Comparative Example 6.

(c) of FIG. 4 is a diagram of electron backscatter diffraction (EBSD) characterization result for Example 5.

(d) of FIG. 4 is a diagram of electron backscatter diffraction (EBSD) characterization result for Example 7.

(e) of FIG. 4 is a diagram of electron backscatter diffraction (EBSD) characterization result for Comparative Example 8.

(f) of FIG. 4 is a diagram of electron backscatter diffraction (EBSD) characterization result for Comparative Example 9.

Figure 5:
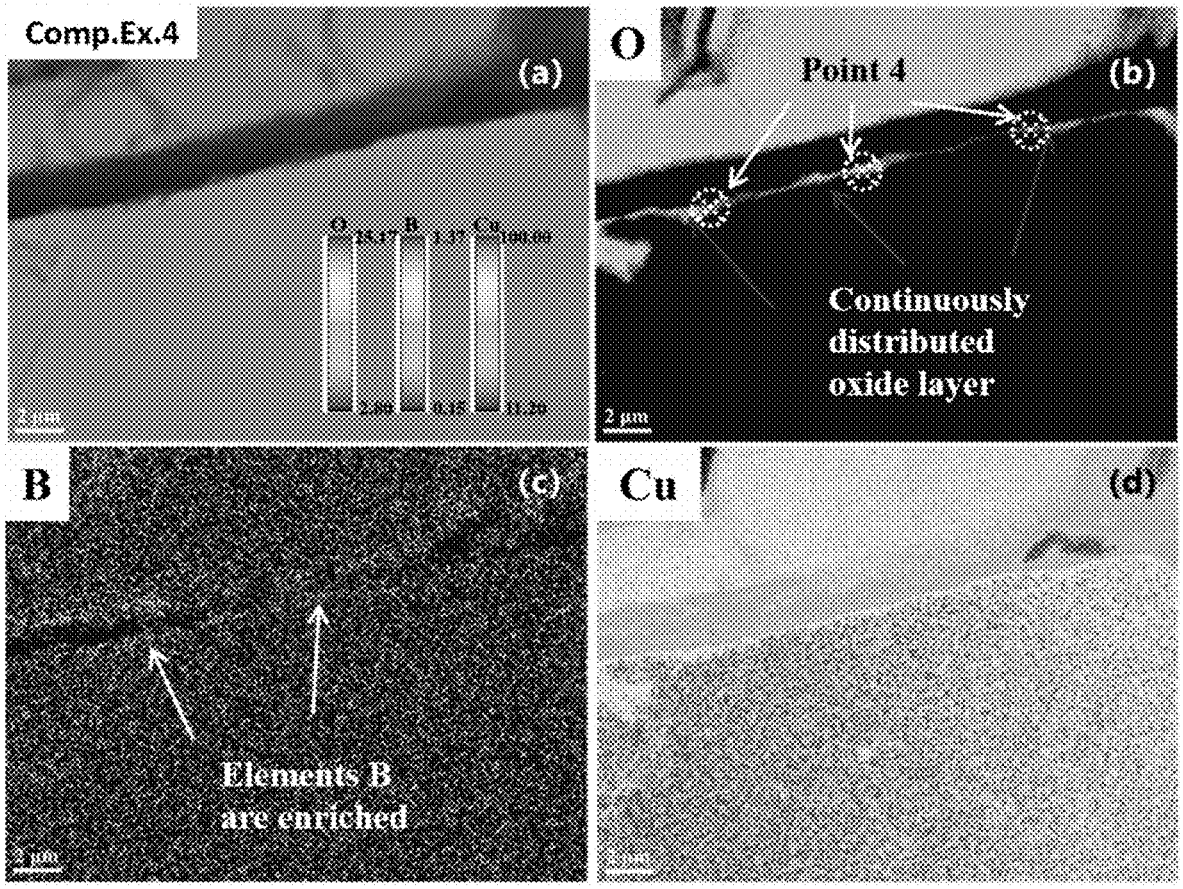

(a) of FIG. 5 is an electron probe microanalysis (EPMA)-based element distribution map in Comparative Example 4.

(b) of FIG. 5 is an electron probe microanalysis (EPMA)-based element distribution map of O in Comparative Example 4.

(c) of FIG. 5 is an electron probe microanalysis (EPMA)-based element distribution map of B in Comparative Example 4.

(d) of FIG. 5 is an electron probe microanalysis (EPMA)-based element distribution map of Cu in Comparative Example 4.

Figure 6:
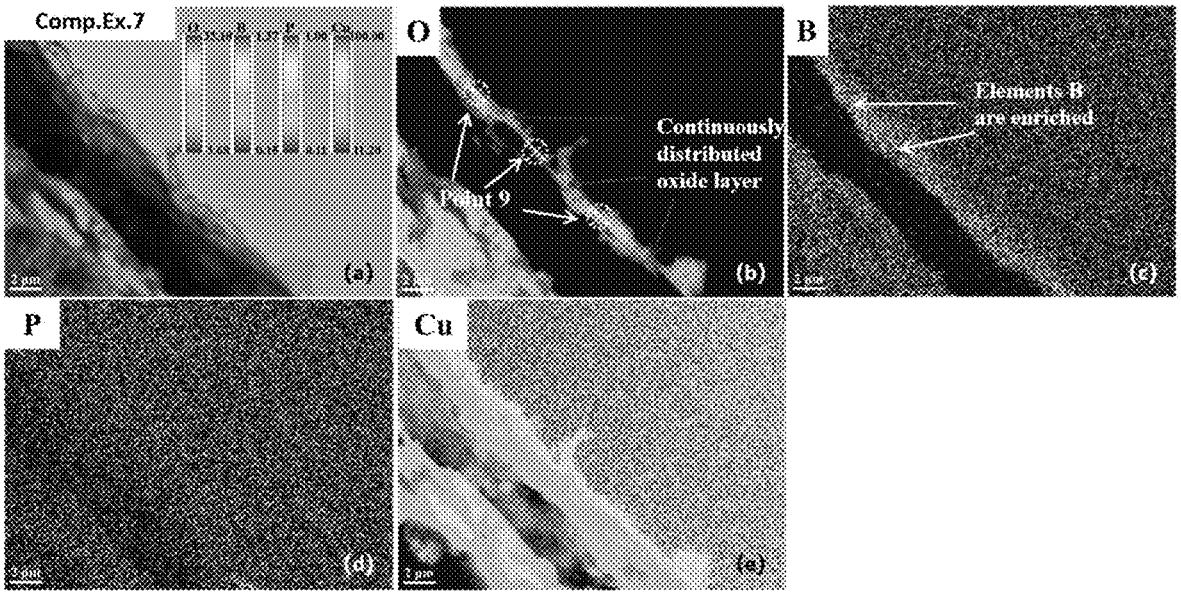

(a) of FIG. 6 is an electron probe microanalysis (EPMA)-based element distribution map in Comparative Example 7.

(b) of FIG. 6 is an electron probe microanalysis (EPMA)-based element distribution map of O in Comparative Example 7.

(c) of FIG. 6 is an electron probe microanalysis (EPMA)-based element distribution map of B in Comparative Example 7.

(d) of FIG. 6 is an electron probe microanalysis (EPMA)-based element distribution map of P in Comparative Example 7.

(e) of FIG. 6 is an electron probe microanalysis (EPMA)-based element distribution map of Cu in Comparative Example 7.

Figure 7:
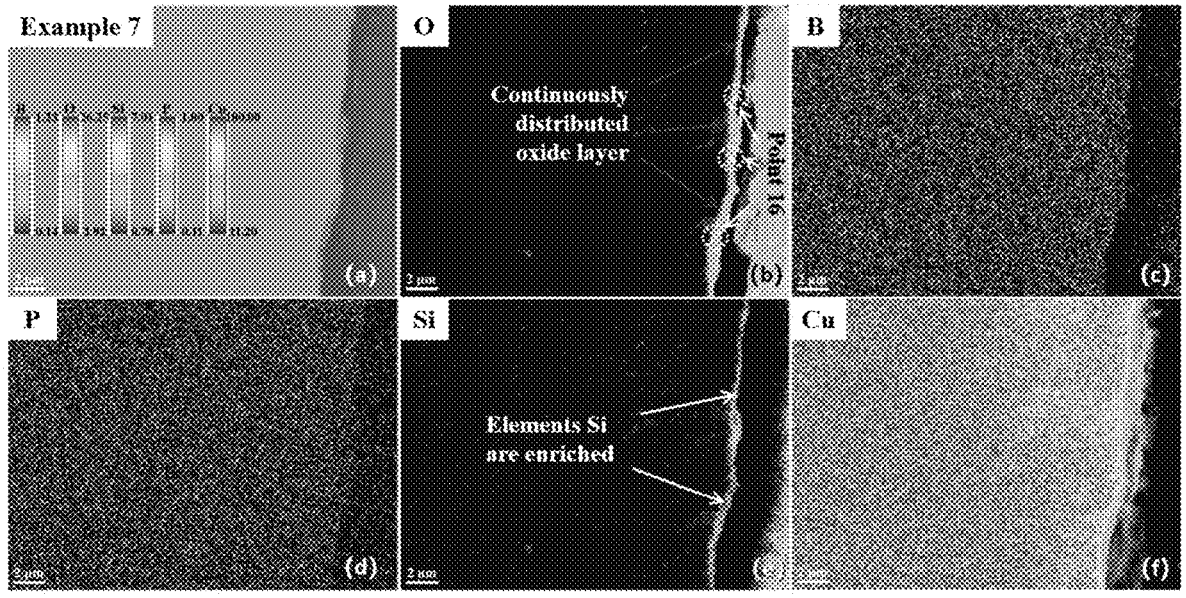

(a) of FIG. 7 is an electron probe microanalysis (EPMA)-based element distribution map in Example 7.

(b) of FIG. 7 is an electron probe microanalysis (EPMA)-based element distribution map of O in Example 7.

(c) of FIG. 7 is an electron probe microanalysis (EPMA)-based element distribution map of B in Example 7.

(d) of FIG. 7 is an electron probe microanalysis (EPMA)-based element distribution map of P in Example 7.

(e) of FIG. 7 is an electron probe microanalysis (EPMA)-based element distribution map of Si in Example 7.

(f) of FIG. 7 is an electron probe microanalysis (EPMA)-based element distribution map of Cu in Example 7.

Figure 8:
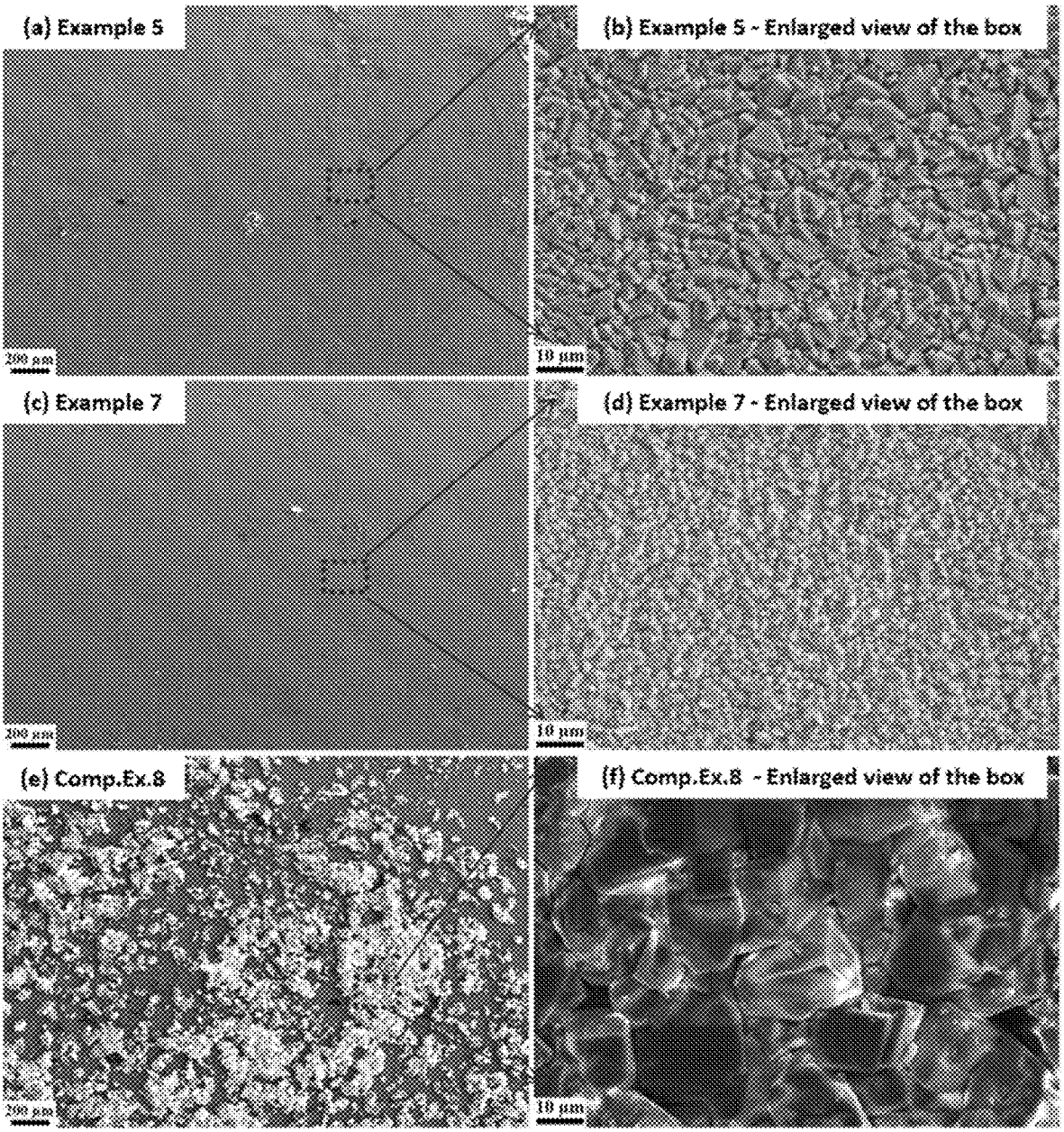

(a) of FIG. 8 is a diagram of surface product morphology formed after an ant-nest corrosion test in Example 5.

(b) of FIG. 8 is an enlarged view of the boxed area in (a) of FIG. 8, illustrating the detailed surface product morphology formed after the ant-nest corrosion test in Example 5.

(c) of FIG. 8 is a diagram of surface product morphology formed after an ant-nest corrosion test in Example 7.

(d) of FIG. 8 is an enlarged view of the boxed area in (c) of FIG. 8, illustrating the detailed surface product morphology formed after the ant-nest corrosion test in Example 7.

(e) of FIG. 8 is a diagram of surface product morphology formed after an ant-nest corrosion test in Comparative Example 8.

(f) of FIG. 8 is an enlarged view of the boxed area in (e) of FIG. 8, illustrating the detailed surface product morphology formed after the ant-nest corrosion test in Comparative Example 8.

DETAILED DESCRIPTION OF THE EMBODIMENTS

To make the objectives, technical solutions, and advantages of embodiments of the present disclosure clearer, the following clearly and completely describes the technical solutions in embodiments of the present disclosure with reference to the accompanying drawings in the embodiments of the present disclosure. Apparently, the described embodiments are some rather than all of the embodiments of the present disclosure. Based on the embodiments of the present disclosure, all other embodiments obtained by a person skilled in the art based on the embodiments of the present invention without creative efforts should fall within the protection scope of the present disclosure.

In the present disclosure, seven examples and nine comparative examples are selected for description, and chemical components in each example and comparative example are shown in Table 1.

S2. Horizontal continuous casting: a casting temperature is 1165° C., a traction speed is 330 mm/min, an inlet flow rate of cooling water is 35 L/min, and a temperature difference between inlet and outlet water is controlled in a range of 16-18° C.

S3. Milling: to ensure uniform removal of an oxide layer from a surface of an ingot, the ingot needs to be straightened before the milling.

S4. Planetary rolling: a feed speed of the planetary rolling is 2.0 m/s, a discharge speed is 25 m/s, and a deformation rate is 88%.

S5. Coil drawing: To eliminate rolling spiral patterns, three passes of coiling drawing processing are performed, an elongation coefficient for first two passes is 1.6, and an elongation coefficient for a subsequent pass is 1.4.

S6. Online annealing: on-line annealing is performed after coiling drawing, an annealing temperature is 605° C., and a feed rate is 375 m/min.

S7. Internal thread forming: an internal thread forming rate is 40 m/min, an equivalent cold working deformation is 16%, and an elongation coefficient is 1.2.

S8. Rewinding and splitting: a rewinding rate is 200 m/min.

S9. Finished product annealing: annealing is performed in a nitrogen atmosphere, an annealing temperature is 520° C., and annealing duration is 30 minutes.

TABLE 1

Specific chemical components (wt. %) and process summaries in Examples 1-7 and Comparative Examples 1-9

| | Sequence number | B | P | Si | B + P | B/P | Si/(B + P) | Impurity element | Cu | Oxidation treatment process |
|---|---|---|---|---|---|---|---|---|---|---|
| Comparative Examples | 1 | 0.0035 | / | / | / | | / | < 0.1, where a content of O < 0.001. | Balance | / |
| | 2 | 0.0055 | / | / | / | | / | | | / |
| | 3 | 0.0135 | / | / | / | | / | | | / |
| | 4 | 0.0135 | / | / | / | | / | | | (50° C. to room temperature)/8° C./min |
| | 5 | 0.0035 | 0.3500 | / | 0.3535 | 0.0100 | | | | / |
| | 6 | 0.0135 | 0.2000 | / | 0.2135 | 0.0675 | | | | / |
| | 7 | 0.0135 | 0.2000 | / | 0.1635 | 0.0675 | / | | | (70° C. to room temperature)/8° C./min |
| Examples | 1 | 0.0550 | 0.300 | 0.0050 | 0.3550 | 0.1833 | 0.0141 | < 0.1, where a content of O < 0.001. | Balance | |
| | 2 | 0.0350 | 0.2700 | 0.0100 | 0.3050 | 0.1296 | 0.0328 | | | / |
| | 3 | 0.0150 | 0.2500 | 0.0150 | 0.2650 | 0.0600 | 0.0566 | | | / |
| | 4 | 0.0150 | 0.2300 | 0.0200 | 0.2450 | 0.0652 | 0.0816 | | | / |
| | 5 | 0.0135 | 0.2000 | 0.0300 | 0.2135 | 0.0675 | 0.1405 | | | / |
| | 6 | 0.0055 | 0.1500 | 0.0500 | 0.1555 | 0.0367 | 0.3215 | | | / |
| | 7 | 0.0135 | 0.2000 | 0.0300 | 0.2135 | 0.0675 | 0.1405 | | | (100° C. to room temperature)/8° C./min |
| Comparative Examples | 8 | / | 0.0300 | / | / | | / | <0.1, where a content of O < 0.001. | Balance | / |
| | 9 | / | 0.3000 | / | / | | / | | | / |

Comparative Examples 1-3, 5 and 6, 8 and 9, and Examples 1-6 are prepared according to the following steps.

S1. Batching and smelting: batching and smelting are performed according to target components, a smelting temperature is 1183° C., and charcoal is used to cover a copper liquid surface during the smelting.

When P and B are added at a same time, a Cu—P intermediate alloy is added first, and then a Cu—B intermediate alloy is added. When P, B and Si are added at a same time, a Cu—P intermediate alloy is added first, a Cu—B intermediate alloy is then added, and a Cu—Si intermediate alloy is finally added. The element boron is added with a Cu-5 wt. % B intermediate alloy, the element P is added with a Cu-14 wt. % P intermediate alloy, and the element Si is added with a Cu-10 wt. % Si intermediate alloy.

After Step S9, oxidation treatment (that is, surface treatment) is performed on a prepared product. A step of the oxidation treatment is as follows: after finished product annealing, when a temperature in a furnace drops to 50° C., removing a prepared product from the furnace and placing the prepared product in an oxygen-containing gas to cool to room temperature, and controlling a cooling rate at 8° C./min. The oxygen-containing gas is a mixture of oxygen and nitrogen, and a volume proportion of oxygen in the mixture is controlled to 30%, to obtain Comparative Example 4.

After Step S9, oxidation treatment is performed on a prepared product. A step of the oxidation treatment is as follows: after finished product annealing, when a temperature in a furnace drops to 70° C., removing a prepared product from the furnace and placing the prepared product in an oxygen-containing gas to cool to room temperature, and controlling a cooling rate at 8° C./min. The oxygen-containing gas is a mixture of oxygen and nitrogen, and a volume proportion of oxygen in the mixture is controlled to 30%, to obtain Comparative Example 7.

After Step S9, oxidation treatment is performed on a prepared product. A step of the oxidation treatment is as follows: after finished product annealing, when a temperature in a furnace drops to 100° C., removing a prepared product from the furnace and placing the prepared product in an oxygen-containing gas to cool to room temperature, and controlling a cooling rate at 8° C./min. The oxygen-containing gas is a mixture of oxygen and nitrogen, and a volume proportion of oxygen in the mixture is controlled to 30%, to obtain Example 7.

A performance test is performed on products obtained in examples and comparative examples.

For a test method and apparatus for ant-nest corrosion resistance, refer to a method and an apparatus for a high-corrosion-resistant copper alloy in the application (CN105143478A). A concentration of formic acid is 0.1%, and an ambient temperature alternates between 40° C./24 h and 20° C./24h. Fifteen parallel straight tubes are taken from each sample, and corrosion duration is 30 days. After ant-nest corrosion is performed on the sample tubes, ant-nest corrosion depths of the samples are observed through the metallography, and test results are recorded, and then distribution of the recorded data and a quantity of abnormal values statistically analyzed through the Nair's (Nair) test for bilateral case (for details, see statistical interpretation of data-detection and treatment of outliers in the normal sample in National Standard GB/T 4883-2008). Quantities of maximum and minimum values to be removed are determined based on results calculated by using the Nair'test. An average value of remaining samples is used as a corrosion depth of the type of samples.

For a test of stress corrosion performance, a test environment is the same as that for the test of ant-nest corrosion resistance. The differences lie in that: in this test, 15 bent tubes are selected as samples, the bent tubes as samples are 180° U-type bent tubes with a bent tube radius of 7 mm; and in a corroded and leaked bent tube, only a sample with a leakage point at a position of the bent tube is counted, and duration in which the copper tube leaks at the bent tube is recorded. A method for recording results of the leakage duration of the samples and a processing method are the same as those in the test of ant-nest corrosion resistance.

Configuration of test conditions, sample preparation and test for the neutral salt spray test are performed according to specifications in GB10125 and EN/ISO9227. (1) Test conditions: an ambient temperature is 35° C., and low brine temperature is 55° C.; (2) a test period is 480h; and (3) sample cleaning and weighing: after the salt spray test is stopped, a sample to be tested is soaked in 20% (mass) diammonium hydrogen citrate for 10 minutes, then washed with water and anhydrous ethanol in turn, and immediately dried and weighed after cleaning.

An electron backscatter diffraction (EBSD) technique was used to study evolution of proportions of the grain size and a special grain boundary angle of the alloy. A device used in the test is ZEISS Gemini 2, and test parameters are set as follows: an acceleration voltage is 20 kV, a working distance ranges from 14 mm to 20 mm, and a step is 0.8 μm. In grain size statistical analysis, at least five EBSD characterization images are selected for samples in a same test parameter condition. Each image is processed by using software AZTEC, and a grain boundary is defined by using an orientation difference angle θ, where $2° \leq \theta < 15°$ indicates a low angle grain boundary (LAGBs), and $\theta \geq 15°$ indicates a high angle grain boundary (HAGBs). An equivalent circle diameter in grain size statistics of each image is read as an average grain size corresponding to the image; and finally, an average value of average grain sizes of at least five images in a same parameter is used as an average grain size of a sample in the parameter condition.

Methods and procedures for antibacterial testing are as follows.

1. Preparation of Test Bacteria Suspension:

A bacterial strain (glycerol bacteria) preserved under freezing condition was selected and opened under aseptic operation, and inoculated in a shaking flask containing 3 mL Luria-Bertani (LB) medium, followed by overnight culture at 37° C. The overnight culture was diluted to 3 mL LB at a ratio of 1:100, and then cultured at 37° C. until a logarithmic growth phase (OD600=0.6-0.8) was reached. 2 mL of bacterial suspension was centrifugally enriched, and then resuspended with equal volume PBS+0.01 g/L yeast extract+0.03 g/L poptone (low nutrition PBS). After being mixed evenly, the bacterial suspension was diluted with low nutrition PBS to OD600=0.01 ($10^6$ CFU/mL).

2. Killing Assay Test Procedure:

The tube was sampled and rolled into a solid rectangular-shaped tube sample of 10 mm×10 mm×2 mm. A sterile 12-well plate was provided, a tube sample was taken with a sterile tweezer, and one tube sample was placed in one well. The 2 mL test bacteria suspension was added into each well, and time was counted immediately. The culture was performed at 30° C. until a bacterium to be tested interacts with the tube sample for 15 minutes, then the planktonic bacterial suspension was prepared.

Plankton: 20 μL plankton bacteria suspension was added to a 96-well plate containing 180 μL PBS to achieve a 10-fold dilution of the planktonic bacterial suspension . . . 5 μL sample solution was added on an LB solid culture medium. After being dried, the added sample solution was put in an incubator at 37° C. for overnight culture, and then the sample solution was taken out in time for quantitative determination of viable bacteria. The sample solution without adding a tube sample was used as the control group (namely, the "Control" in (a) of FIG. 2).

3. Test Strain:

Gram-positive bacteria: *Staphylococcus aureus S. aureus* Newman.

The test results are shown in Table 2 to Table 4 and (a) of FIG. 1 to (f) of FIG. 8. In the drawings, "comparative example" is abbreviated as "Comp.Ex.".

TABLE 2

Statistical results of grain sizes and proportions of grain boundaries 23 and 29 in Examples and Comparative Examples

| | Average grain size (μm) | Proportion of grain boundary Σ3 (%) | Proportion of grain boundary Σ9 (%) | Proportion of grain boundaries Σ3 and Σ9(%) | Ratio of grain boundary Σ3 to grain boundary Σ9 |
|---|---|---|---|---|---|
| Comparative Example 1 | 8.34 | 53.5 | 4.80 | 58.30 | 11.15 |
| Comparative Example 2 | 7.92 | 54.8 | 4.95 | 59.75 | 11.07 |
| Comparative Example 3 | 7.51 | 55.0 | 5.02 | 60.02 | 10.96 |
| Comparative Example 4 | 7.50 | 55.1 | 5.02 | 60.12 | 10.98 |
| Comparative Example 5 | 8.17 | 54.2 | 4.85 | 59.05 | 11.18 |
| Comparative Example 6 | 6.02 | 62.8 | 3.01 | 65.81 | 20.86 |
| Comparative Example 7 | 5.95 | 62.7 | 3.07 | 65.77 | 20.42 |
| Example 1 | 6.49 | 58.3 | 4.11 | 62.41 | 14.18 |
| Example 2 | 6.18 | 60.2 | 4.84 | 65.04 | 12.44 |
| Example 3 | 5.82 | 61.5 | 5.23 | 66.73 | 11.76 |
| Example 4 | 5.62 | 62.5 | 5.54 | 68.04 | 11.28 |
| Example 5 | 5.46 | 62.6 | 5.79 | 68.39 | 10.81 |
| Example 6 | 6.55 | 58.5 | 4.07 | 62.57 | 14.37 |
| Example 7 | 5.44 | 63.2 | 5.78 | 68.98 | 10.93 |
| Comparative Example 8 | 10.71 | 36.6 | 3.01 | 39.61 | 12.16 |
| Comparative Example 9 | 7.66 | 51.3 | 2.62 | 53.92 | 19.58 |

TABLE 3

Statistical results of content (wt. %) of film elements and a film thickness (μm) in Comparative Example 4, Comparative Example 7, and Example 7

| | | O | B | P | Si | Cu | Film thickness |
|---|---|---|---|---|---|---|---|
| Comparative Example 4 | P4 | 17.248 | 0.805 | / | / | 81.947 | 0.33 |
| Comparative Example 7 | P9 | 16.043 | 0.633 | 0.042 | / | 83.281 | 0.57 |
| Example 7 | P16 | 22.556 | 0.882 | 0.035 | 0.119 | 76.400 | 0.76 |

Note:
P4 refers to Point 4 in (b) of FIG. 5; P9 refers to Point 9 in (b) of FIG. 6; and P16 refers to Point 16 in (b) of FIG. 7.

TABLE 4

Summary of bactericidal rate, maximum corrosion depth in a 0.1% formic acid environment, corrosion weight loss in neutral salt spray, duration for resistance to stress corrosion leakage of a bent tube in a 0.1% formic acid environment, fluidity of molt, and processability

| | Sequence number | 15-minute bactericidal rate (%) | Maximum corrosion depth (μm) | Corrosion weight loss rate ($10^{-5}$ g/h) | Duration for resistance to stress corrosion leakage (days) | Fluidity of molten solution | Processability |
|---|---|---|---|---|---|---|---|
| Comparative Examples | 1 | 85.95 | 48 | 11.01 | 80 | Good | Good |
| | 2 | 65.85 | 35 | 10.40 | 97 | Normal | Normal |
| | 3 | 50.43 | 32 | 9.22 | 100 | Normal | Normal |
| | 4 | 45.94 | 24 | 9.02 | 109 | Normal | Normal |
| | 5 | 88.21 | 45 | 9.53 | 82 | Normal | Normal |
| | 6 | 65.11 | 25 | 7.59 | 104 | Good | Good |
| | 7 | 60.79 | 20 | 5.57 | 112 | Good | Good |
| Examples | 1 | 84.31 | 43 | 9.14 | 85 | Normal | Normal |
| | 2 | 78.43 | 31 | 7.63 | 98 | Good | Good |
| | 3 | 76.73 | 31 | 6.22 | 102 | Good | Good |
| | 4 | 73.44 | 25 | 5.80 | 104 | Excellent | Excellent |
| | 5 | 71.26 | 20 | 5.21 | 106 | Excellent | Excellent |

TABLE 4-continued

Summary of bactericidal rate, maximum corrosion depth in a 0.1% formic acid environment, corrosion weight loss in neutral salt spray, duration for resistance to stress corrosion leakage of a bent tube in a 0.1% formic acid environment, fluidity of molt, and processability

| | Sequence number | 15-minute bactericidal rate (%) | Maximum corrosion depth (μm) | Corrosion weight loss rate ($10^{-5}$ g/h) | Duration for resistance to stress corrosion leakage (days) | Fluidity of molten solution | Processability |
|---|---|---|---|---|---|---|---|
| | 6 | 89.33 | 44 | 9.47 | 83 | Good | Good |
| | 7 | 70.96 | 15 | 4.53 | 120 | Excellent | Excellent |
| Comparative | 8 | 37.46 | 145 | 96.6 | 13 | Good | Good |
| Examples | 9 | 35.25 | 63 | 17.6 | 74 | Normal | Normal |

(a) to (i) of FIG. 1 are metallographic diagrams of ant-nest corrosion in Comparative Examples 1-3, 6, 8-9 and Examples 4-5 and 7 respectively.

It may be learned from Comparative Examples 1-3 that, when the content of B increases from 0.0035 wt % (Comparative Example 1) to 0.0135 wt % (Comparative Example 3), corrosion resistance of the alloy is improved, a corrosion depth decreases from 48 μm to 32 μm, a weight loss rate decreases from $11.01\times10^{-5}$ g/h to $9.22\times10^{-5}$ g/h, and leakage duration is extended from 80 days to 100 days, which indicates that the corrosion resistance of the alloy gradually increases with an increase in the content of B. This is mainly because proportions of grain boundaries Σ3 and Σ9 in a boron-containing alloy increase with an increase in the content of B (Table 2). The high proportions of grain boundaries Σ3 and Σ9 may reduce corrosion sensitivity of the alloy, and inhibit a corrosion extension path of the alloy, thereby improving the corrosion resistance of the alloy.

In Comparative Examples 1-3, with an increase in the content of B content, a short-term 15-minute bactericidal rate of the alloy decreases from 85.95% (Comparative Example 1) to 50.43% (Comparative Example 3). This is because the element B is added separately, and a release rate of copper ions caused by a grain size refinement effect of the alloy is not significantly increased due to an impact of a proportion of a special grain boundary. A reduction effect of surface active points caused by an increase in the proportion of the special grain boundary is greater than an increase effect of release of copper ions caused by grain refinement, and thus that a bactericidal rate of the alloy decreases with the addition of the element B.

It may be learned from Comparative Examples 1-3 that, fluidity of a melt and processability become worse with an increase in the content of B. This is because an oxide in a melt cannot be effectively removed when B is added separately. Inclusion of the oxide not only increases viscosity, but also causes a crack during solidification, thus deteriorating processing performance.

On a basis of the addition of the element B, the element P is further added in the present disclosure. For details, refer to Comparative Examples 1, 3, 5, and 6. By comparing Comparative Example 1 with Comparative Example 5, and Comparative Example 3 with Comparative Example 6, it is found that the addition of P may improve both the corrosion resistance and bactericidal rate of the alloy. The improvement of the corrosion resistance is mainly because synergistic addition of B and P may optimize and promote formation of the special grain boundary, increase a proportion of Σ3+Σ9, and decrease corrosion activity of grain boundaries. In addition, the addition of P may further refine a grain size of the alloy, for example, a grain size (6.02 μm) in Comparative Example 6 is lower than a grain size (7.51 μm) in Comparative Example 3, so that the release rate of copper ions is improved, and a bactericidal rate is further improved.

In comparison with Comparative Example 6 and Example 5, after the element Si is added, a 15-minute bactericidal rate of the alloy increases from 65.11% in Comparative Example 6 to 71.26% in Example 5, a maximum corrosion depth decreases from 25 μm in Comparative Example 6 to 20 μm in Example 5, a corrosion weight loss rate decreases from $7.59\times10^{-5}$ g/h in Comparative Example 6 to $5.21\times10^{-5}$ g/h in Example 5, and duration for resistance to stress corrosion leakage increases from 104 days in Comparative Example 6 to 106 days in Example 5. This indicates that on the basis of B and P, the antibacterial performance and corrosion resistance of the alloy are further optimized after the addition of the element Si. This is mainly because the addition of the element Si decreases the grain size of the alloy and increases proportions of the grain boundaries Σ3 and Σ9. In addition, after the element Si is added, the fluidity of the melt and processability of the alloy are further improved. This is because the element Si may effectively reduce a viscosity of the melt and an interfacial tension, thereby significantly improving the fluidity of the melt. In addition, the content of the element Si is controlled to be less than 0.05 wt %, so that a Cu—Si phase may be avoided, and processability performance of the material may be improved.

Compared with Example 1 to Example 5, the corrosion resistance of the alloy is gradually improved, and the corrosion depth decreases from 43 μm in Example 1 to 20 μm in Example 5; and the weight loss rate decreases from $9.14\times10^{-5}$ g/h in Example 1 to $5.21\times10^{-5}$ g/h in Example 5. This indicates that after contents and proportions of B, P, and Si are optimized, the proportions of grain boundaries Σ3 and Σ9 may be improved (up to 68.39% in Example 5), and the corrosion resistance may be strengthened (refer to Table 4).

In Example 1 to Example 5, the antibacterial performance of the alloy decreases from 84.31% in Example 1 to 71.26% in Example 5. After the proportions of the contents of B, P, and Si are optimized, the grain size of the alloy gradually decreases from Example 1 to Example 5, so that a release effect of copper ions gradually increases. However, in Example 1 to Example 5, the proportions of the grain boundaries Σ3 and Σ9 of the alloy gradually increases, a reduction effect of surface active points caused by an increase in the proportion of the special grain boundary is greater than an increase effect of release of copper ions caused by grain refinement, and thus the bactericidal rate of the alloy decreases. It should be noted that, although the bactericidal rate of the alloy in Example 1 to Example 5 gradually decreases, the bactericidal rate in Example 5 still exceeds 70%, and is still significantly better than that of an alloy in a conventional technical (refer to (a) to (j) of FIG. 2 and Table 4).

In Example 4 and Example 5, the fluidity of the melt and processability are also relatively excellent. This is because based on adjustment of the proportions of B, P, and Si, oxygen may be removed better, and a purer melt may be formed, thereby reducing obstruction of inclusions to the fluidity, improving purity of a material matrix, and lowering a risk of cracks caused by inclusions during processing. In Example 6, compared with Example 4 and Example 5, the fluidity of the melt and processability are slightly reduced. This is because in Example 6, a large amount of the element Si is added, and due to the addition of the large amount of the element Si, a Cu—Si brittle phase is easily formed. Uneven distribution of precipitated phases results in a decrease in casting fluidity, and stress concentration is easy to form in subsequent processing due to the existence of the precipitated phases, which reduces the processability of the alloy (refer to Table 4).

(a) to (f) of FIG. 4 are diagrams of EBSD characterization results for Comparative Example 3, Comparative Example 6, Example 5, Example 7, and Comparative Examples 8 and 9 respectively.

Oxidation treatment was performed on the alloys in Comparative Example 3, Comparative Example 6, and Example 5 to obtain Comparative Example 4, Comparative Example 7, and Example 7. To systematically assess an impact of oxidation treatment on a surface of the material, two tubes were randomly selected for sampling analysis in each example or comparative example, as shown in (a) to (b) of FIG. 3. It may be learned from (a) to (b) of FIG. 3 that, after the oxidation treatment, a surface color of the sample in each example or comparative example does not change significantly, which indicates that an oxidation treatment process used in the present disclosure can effectively maintain an original appearance of a product, meeting a strict requirement for appearance consistency of a material in actual application.

After the oxidation treatment was performed on the alloy surface, a continuous oxide film layer appeared on the alloy surface, as shown in (a) to (d) of FIG. 5, (a) to (e) of FIG. 6, and (a) to (f) of FIG. 7. A thickness and element distribution of the oxide film layer of the oxidized alloy were tested. The results are shown in Table 3.

A statistical method for a film thickness is as follows: in each map of distribution of oxygen content at the EPMA film layer, film thickness data is collected at intervals of 1 micron. For each sample, at least five observation pictures are selected, and a quantity of film thickness statistics points for each sample is not less than 50. Finally, a film thickness average value of all statistical points of a same sample is used as a continuous film thickness measurement value of the sample.

A statistical method for element content is as follows: For point (Point) of energy spectrum data, energy spectrum data from at least three points per image is collected, and an average value of the data from the points is used as an element content detection result of the sample film layer.

It may be learned from Table 3 that, in the oxide film layer, the elements B, Si, P, and O are enriched. This is mainly because B, Si, and P are relatively strong oxygen-friendly elements. When an alloy surface is in contact with oxygen, the elements B, Si, and P that are relatively strong oxygen-friendly are migrated to the surface through diffusion under high temperature, and react with oxygen, so that an oxide film layer is formed on the alloy surface, and finally oxygen-friendly elements are enriched in a region of the surface of the material.

Compared with Comparative Example 3 and Comparative Example 4, when a content of boron is 0.0135 wt. % and there is no addition of P and Si, the corrosion resistance in Comparative Example 4 is significantly improved after oxidation treatment. Specifically, the maximum corrosion depth decreases from 32 μm to 24 μm, the corrosion weight loss rate in neutral salt spray decreases from $9.22\times10^{-5}$ g/h to $9.02\times10^{-5}$ g/h, and duration for resistance to stress corrosion leakage is extended from 100 days to 109 days. However, the bactericidal rate decreases from 50.43% to 45.94%, which indicates that oxidation treatment slightly weakens the antibacterial performance.

Compared with Comparative Example 6 and Comparative Example 7, when a content of B in the alloy is 0.0135 wt. % and a content of P is 0.20 wt. %, in Comparative Example 7, the corrosion resistance is further enhanced after oxidation treatment is performed at a high temperature, the maximum corrosion depth decreases from 25 μm to 20 μm, the weight loss rate in neutral salt spray decreases by 26.6% ($7.59\times10^{-5}$ g/h→$5.57\times10^{-5}$ g/h), and the duration for resistance to stress corrosion leakage is prolonged to 112 days (increased by 7.7%). The bactericidal rate decreases from 65.11% to 60.79%, with a drop of 4.3%.

Compared with Example 5 and Example 7, when the content of B in the alloy is 0.0135 wt. %, the content of P is 0.2 wt. %, and the content of Si is 0.03 wt. %, in Example 7, optimal corrosion resistance is exhibited after oxidation treatment is performed at a higher temperature, the maximum corrosion depth decreases from 20 μm to 15 μm, the weight loss rate in neutral salt spray decreases to $4.53\times10^{-5}$ g/h (decreased by 13.1%), and the duration for resistance to stress corrosion leakage is prolonged to 120 days (increased by 13.2%). The bactericidal rate decreases only slightly from 71.26% to 70.96%, indicating that oxidation treatment has a limited impact on the bactericidal rate under this condition.

The above phenomenon is caused by that the oxidation treatment does not change a microstructure of the copper matrix, but causes the surface to form a dense oxide film. The oxide film effectively inhibits a corrosion process of the matrix by using a physical barrier, so that the corrosion resistance of the material is significantly improved. However, the dense oxide film also reduces the release rate of copper ions, resulting in a slight attenuation of the antibacterial performance. This result shows that the corrosion resistance may be significantly improved by sacrificing a small amount of antibacterial performance, which reflects a tradeoff effect in adjustment of function and characteristics of a copper-based material.

As addition of elements in Cu is changed from addition of single B to binary composite addition of B—P, and then to ternary composite addition of B—P—Si, after the alloy is oxidized, the film thickness increases from 0.33 μm (in Comparative Example 4) to 0.76 μm (in Example 7), and a hyperoxia region extends to a deeper layer. In addition, the elements B, P, and Si are enriched in the film layer to form a composite protective layer.

Protective efficacy of the film layer is closely related to element distribution: high oxygen content (>16 wt. %) is the basis for corrosion resistance; and adjustment of the composition of the film layer based on the element B/P/Si may inhibit local corrosion through grain boundary passivation.

According to film composition analysis in Table 3, beneficial effects of oxidation treatment are mainly due to the following mechanisms:

Formation of a dense oxide layer: After the treatment, a content of oxygen in the film layer is significantly increased (up to 22.556 wt. % in Example 7), which helps to form a $Cu_2O/CuO$ oxide layer adjusted by B, P, and Si on the surface. This layer can effectively prevent penetration of a corrosive medium, and is the basis for improving corrosion resistance.

Synergistic effect of boron and silicon: In a silicon-containing alloy (for example, in Example 7), boron (0.882 wt. %) and silicon (0.119 wt. %) coexist in a film layer to form a composite oxide (refer to Table 3), which may fill defects of a surface film layer and reduce a corrosion tendency.

Passivation effect of element phosphorus: The element phosphorus is detected in both the film layer in Comparative Example 7 and the film layer in Example 7. Selective segregation of phosphorus at grain boundaries can passivate active dissolution points and reduce pitting sensitivity, which is more obvious in oxidation treatment sampling of a B—P—Si ternary adjustment copper alloy.

The oxidation treatment has the most significant optimization effect on a silicon-containing alloy (in Example 7), which maintains a bactericidal rate of more than 70%, and achieves excellent corrosion resistance with the corrosion depth of 15 μm, the weight loss rate of $4.53\times10^{-5}$ g/h, and duration for resistance to stress corrosion leakage of 120 days.

Comparing alloy products before and after oxidation treatment, it may be learned that under a condition of constant alloy composition, oxidation treatment significantly optimizes the corrosion resistance of materials through temperature gradient control, which is manifested in simultaneous improvement of three key indexes: corrosion depth, weight loss rate, and duration for resistance to stress corrosion leakage. This indicates that the oxidation treatment process may improve the corrosion resistance of copper alloys by 20% to 25% and prolong the duration for resistance to stress corrosion leakage by 8% to 13% by constructing a composite oxide film rich in elements oxygen, boron and silicon on the premise of constant alloy composition. However, this process slightly reduces the bactericidal rate (by 4.3% to 7.1%), which is related to a case that the oxide film layer on the surface blocks dissolution of copper ions. A product prepared in this process may be applied to an environment having high requirements for corrosion resistance.

It should be noted that, the dense oxide film still has a genetic effect after ant-nest corrosion, and a corrosion product film obtained after the ant-nest corrosion is still dense, and the result may be verified in (a) to (f) of FIG. 8. It may be seen from (a) to (f) of FIG. 8 that, the surface corrosion product film in Example 7 is denser, and the surface corrosion product particles are finer and denser, indicating that Example 7 has better corrosion resistance.

Comparing Examples 1-7 with Comparative Examples 1-9, the corrosion resistance and antibacterial performance of the copper alloy in Examples are obviously better than those in Comparative Examples 1-9, which indicates that both the corrosion resistance and antibacterial performance of the copper alloy of the present disclosure are improved compared with those of a conventional TP2 copper tube (in Comparative Example 9).

It may be learned from examples that, in the present disclosure, low boron (0.005-0.015 wt. %) and appropriate phosphorus (0.15-0.25 wt. %) and silicon (0.01-0.03%) may form a copper alloy material with features of "high antibacterial performance and resistance to multiple corrosion".

Typical formula in examples/comparative examples (15-minute bactericidal rate>70%, duration for resistance to stress corrosion leakage>100 days):

Example 4 (Cu-0.015B-0.23P-0.02Si): The 15-minute bactericidal rate is 73.44%, the maximum corrosion depth is 25 μm, the corrosion weight loss rate is $5.80\times10^{-5}$ g/h, and the duration for resistance to stress corrosion leakage is 104 days. Both antibacterial performance and corrosion resistance are considered, and this material is applicable to harsh service environments such as marine engineering components and heat exchange devices.

Example 5 (Cu-0.0135B-0.20P-0.03Si): The 15-minute bactericidal rate is 71.26%, the maximum corrosion depth is 20 μm, the corrosion weight loss rate is $5.21\times10^{-5}$ g/h, and the duration for resistance to stress corrosion leakage is 106 days. Both antibacterial performance and corrosion resistance are considered, and this material is applicable to harsh service environments such as marine engineering components and heat exchange devices.

Example 7 (Cu-0.0135B-0.20P-0.03Si (oxidation treatment)): The 15-minute bactericidal rate is 70.96%, the maximum corrosion depth is 15 μm, the corrosion weight loss rate is $4.53\times10^{-5}$ g/h, and the duration for resistance to stress corrosion leakage is 120 days. Partial antibacterial rates are sacrificed for ultimate corrosion resistance, and this material is applicable to harsh service environments such as marine engineering components and heat exchange devices.

Finally, it should be noted that the foregoing embodiments are merely intended for describing the technical solutions of the present disclosure but not for limiting the present disclosure. Although the present disclosure is described in detail with reference to the foregoing embodiments, persons of ordinary skill in the art should understand that they may still make modifications to the technical solutions described in the foregoing embodiments or make equivalent replacements to some or all technical features thereof without departing from the scope of the technical solutions of the embodiments of the present disclosure.

What is claimed is:

1. A corrosion-resistant antibacterial copper alloy, comprising components having the following contents: B: 0.0035-0.055 wt. %; P: 0.15-0.35 wt. %; Si: 0.005-0.05 wt. %; an unavoidable impurity element having a content less than 0.1 wt. %; and a balance being copper, wherein an average grain size of the copper alloy ranges from 4 μm to 7 μm, in the copper alloy, a total proportion of grain boundaries Σ3 and Σ9 satisfies: $60\%\leq\Sigma3+\Sigma9\leq75\%$, and a ratio of a proportion of the grain boundary Σ3 to a proportion of the grain boundary Σ9 ranges from 10.5 to 21.0.

2. The corrosion-resistant antibacterial copper alloy according to claim 1, wherein in the copper alloy, a content of B ranges from 0.005 wt. % to 0.015 wt. %; and/or, a content of P ranges from 0.15 wt. % to 0.25 wt. %; and/or, a content of Si ranges from 0.015 wt. % to 0.05 wt. %.

3. The corrosion-resistant antibacterial copper alloy according to claim 1, wherein in the copper alloy, a content of B ranges from 0.0135 wt. % to 0.015 wt. %; and/or, a content of P ranges from 0.20 wt. % to 0.25 wt. %; and/or, a content of Si ranges from 0.015 wt. % to 0.03 wt. %.

4. The corrosion-resistant antibacterial copper alloy according to claim 1, wherein the average grain size of the copper alloy ranges from 4.0 μm to 6.0 μm; and/or, the total proportion of the grain boundaries Σ3 and Σ9 satisfies: 65%≤Σ3+Σ9≤70%; and/or, the ratio of the proportion of the grain boundary Σ3 to a proportion of the grain boundary Σ9 ranges from 10.5 to 15.

5. The corrosion-resistant antibacterial copper alloy according to claim 1, wherein the average grain size of the copper alloy ranges from 5.4 μm to 5.9 μm; and/or, the total proportion of the grain boundaries Σ3 and Σ9 satisfies: 66%≤Σ3+Σ9≤69%; and/or, the ratio of the proportion of the grain boundary Σ3 to a proportion of the grain boundary Σ9 ranges from 10.5 to 12.

6. The corrosion-resistant antibacterial copper alloy according to claim 1, wherein in the copper alloy, a total content of B and P ranges from 0.155 wt. % to 0.4 wt. %; and/or, a mass ratio of B to P satisfies: 0.03≤B/P≤0.2; and/or, a mass ratio of Si to a total mass of B and P satisfies: 0.01≤Si/(B+P)≤0.35.

7. The corrosion-resistant antibacterial copper alloy according to claim 1, wherein in the copper alloy, a total content of B and P ranges from 0.20 wt. % to 0.26 wt. %; and/or, a mass ratio of B to P satisfies: 0.04≤B/P≤0.07; and/or, a mass ratio of Si to a total mass of B and P satisfies: 0.05≤Si/(B+P)≤0.15.

8. The corrosion-resistant antibacterial copper alloy according to claim 1, wherein a 15-minute bactericidal rate of the copper alloy is greater than or equal to 70%; a maximum corrosion depth is less than or equal to 44 μm after 30 days of alternate cold and hot corrosion in a 0.1% formic acid aqueous solution environment; a corrosion weight loss rate is less than or equal to $9.5\times10^{-5}$ g/h after exposure to a neutral salt spray environment for 480 h; and duration for resistance to stress corrosion leakage is greater than or equal to 80 days.

9. The corrosion-resistant antibacterial copper alloy according to claim 8, wherein the 15-minute bactericidal rate of the copper alloy is greater than or equal to 70%; the maximum corrosion depth is less than or equal to 30 μm after 30 days of alternate cold and hot corrosion in the 0.1% formic acid aqueous solution environment; the corrosion weight loss rate is less than or equal to $6\times10^{-5}$ g/h after exposure to the neutral salt spray environment for 480 h; and the duration for resistance to stress corrosion leakage is greater than or equal to 103 days.

10. The corrosion-resistant antibacterial copper alloy according to claim 1, wherein an outer surface of the copper alloy further has an oxide film layer.

11. The corrosion-resistant antibacterial copper alloy according to claim 10, wherein a thickness of the oxide film layer ranges from 0.20 μm to 0.95 μm; and/or, the oxide film layer comprises oxides of B, P, and Si, wherein contents of O, B, P, and Si are O: 16-24 wt. %, B: 0.60-0.90 wt. %, P: 0.03-0.05 wt. %, and Si: 0.10-0.13 wt. %, respectively.

12. The corrosion-resistant antibacterial copper alloy according to claim 11, wherein a thickness of the oxide film layer ranges from 0.3 μm to 0.8 μm.

13. The corrosion-resistant antibacterial copper alloy according to claim 10, wherein a 15-minute bactericidal rate of the copper alloy is greater than or equal to 70%; a maximum corrosion depth is less than or equal to 16 μm after 30 days of alternate cold and hot corrosion in a 0.1% formic acid aqueous solution environment; a corrosion weight loss rate is less than or equal to $5.0\times10^{-5}$ g/h after exposure to a neutral salt spray environment for 480 h; and duration for resistance to stress corrosion leakage is greater than or equal to 115 days.

* * * * *